US006685602B2

(12) United States Patent
Colosky, Jr. et al.

(10) Patent No.: US 6,685,602 B2
(45) Date of Patent: Feb. 3, 2004

(54) GRAVITY-INDEPENDENT CONSTANT FORCE RESISTIVE EXERCISE UNIT

(76) Inventors: Paul E. Colosky, Jr., 14710 Dawn Vale Dr., Houston, TX (US) 77063; Tara M. Ruttley, 14710 Dawn Vale Dr., Houston, TX (US) 77062

( * ) Notice: Subject to any disclaimer, the term of this patent is extended or adjusted under 35 U.S.C. 154(b) by 245 days.

(21) Appl. No.: 09/931,142

(22) Filed: Aug. 16, 2001

(65) Prior Publication Data

US 2002/0025891 A1 Feb. 28, 2002

Related U.S. Application Data

(60) Provisional application No. 60/225,871, filed on Aug. 17, 2000.

(51) Int. Cl.[7] ..... A63B 21/045

(52) U.S. Cl. ..... 482/127; 482/904; 482/122

(58) Field of Search ..... 482/127, 121–129, 482/130, 142, 148, 54, 51, 66, 72, 124, 905, 904

(56) References Cited

U.S. PATENT DOCUMENTS

| | | | |
|---|---|---|---|
| 1,139,126 | A | 5/1915 | Kerns |
| 3,596,907 | A | 8/1971 | Brighton et al. |
| 4,944,511 | A | 7/1990 | Francis |
| 5,226,867 | A | 7/1993 | Beal |
| 5,509,873 | A | 4/1996 | Corn |
| 5,540,642 | A | 7/1996 | Sprague |
| 5,733,231 | A | 3/1998 | Corn et al. |
| 6,099,447 | A | 8/2000 | Ramsaroop |
| 6,123,649 | A | 9/2000 | Lee et al. |
| 6,149,094 | A | 11/2000 | Martin et al. |

OTHER PUBLICATIONS

Convertino, "Exercise as a countermeasure for physiological adaptation to prolonged space flight," Medicine & Science in Sports & Exercise, 1996, PP 999–1014, USA.

Nicogossian, "Countermeasures To Space Deconditioning," Space Physiology & Medicine, 3rd edition, 1993, pp 447–467, Williams & Wilkins, USA.

P.E.DiPrompero, "Cycling in Space to Simulate Gravity," Int.J. Sports Med. 18 (1997), vol. 18 (suppl. 4) pp$^{s}$24–26, Italy.

Arnheim, Principles of Athletic Training, WCB, McGraw Hill, 1997, pp. 74–79, 9th Edition , New York.

Baechley, Editor, "Essentials of Strength Training & Conditioning," Human Kinetics, 1994, pp406–408, USA.

Harman, Resistance Training Modes: A Biomechanical Perspective, Strength & Conditioning, Apr. 1994, pp 59–65, USA.

(List continued on next page.)

*Primary Examiner*—Jerome W. Donnelly
(74) *Attorney, Agent, or Firm*—James K. Poole, Esq.

(57) ABSTRACT

This invention describes a novel gravity-independent exercise unit designed for use in microgravity, or on the ground, as a means by which to counter muscle atrophy and bone degradation due to disuse or underuse. Modular resistive packs comprising constant torque springs provide constant force opposing the withdrawal of an exercise cable from the device. In addition to uses within the space program, the compact resistive packs of the CFREU allow the unit to be small enough for easy use as a home gym for personal use, or as a supplement for rehabilitation programs. Resistive packs may be changed conveniently out of the CFREU according to the desired exercise regimen. Thus, the resistive packs replace the need for expensive, heavy, and bulky traditional weight plates. The CFREU may be employed by hospitals, rehabilitation and physical therapy clinics, and other related professional businesses.

36 Claims, 17 Drawing Sheets

OTHER PUBLICATIONS

Colliander, Effects of eccentric & concentric muscle actions in resistance training, "Acta Physical Scand." 1990, pp. 31–39, Stockholm, Sweden.

Hoppeler, "Recommendations for Muscle Research in Space," Int. J Sports Med. 18, (1997) pps280–282, Stuttgart, New York.

LeBlanc, "Muscle Atrophy During Long Duration Bed Rest," Int. J Sports Med. 18, 1997, pp•s283–s334, Stuttgard, New York.

Hickson, "Skeletal muscle fiber type, resistance training, and strength–related performance," (1994), Medicine & Science in Sports & Exercise, pp 593–598, USA.

Booth, "Molecular Events Underlying Skeletal Muscle Atrophy & the Development of Effective Countermeasures," Int. J. Sports Med. 18, (1997), pp. s265–s269, Stuttgart, New York.

Essfeld, "The Strategic Role of Exercise Devices in Manned Spaceflight," Microgravity Sci. technol. III, (1990) pp 180–183, Hanser Publishers, Munich.

Kreitenberg,"The Space Cycle ™" Self Powered Human Centrifuge: A Proposed Countermeasure for Prolonged Human Spaceflight, Aviation, Space & Environmental Medicine, vol. 69,No. i, pp 66–72 Jan. 1998.

GRAVITY-INDEPENDENT CONSTANT FORCE RESISTIVE EXERCISE UNIT

REFERENCE TO RELATED APPLICATIONS

This application claims priority from Applicants' provisional application, U.S. Ser. No. 60/225,871, filed Aug. 17, 2000.

GOVERNMENT SPONSORSHIP

Research and development supporting this application have been supported by the U.S. Government (NASA) under NASA contract number NAS 9-01025, and the government retains a nonexclusive license under this contract and SBIR 00-1 Solicitation, Para. 5.10.

BACKGROUND OF THE INVENTION

1. Field of the Invention

This invention describes a novel gravity-independent exercise unit designed for use in microgravity, or on the ground, as a means by which to counter muscle atrophy and bone degradation due to disuse or underuse.

2. Description of the Relevant Art

Exposing humans to weightlessness during space flight induces significant structural and functional changes in the musculoskeletal system. These changes are manifested as muscle atrophy and bone degradation accompanied by neuromuscular changes including muscle fatigue and weakness, abnormal reflex behavior, and diminished neuromuscular efficiency, as noted by Nicogossian in "Countermeasures to space deconditioning," *Space Physiology and Medicine, Third Ed.,* eds. Nicogossian et al., Williams & Wilkins, Baltimore (1994), pp. 447–469. Support-unloading and structural changes of the muscle and bone seem to be the main causes of these functional abnormalities. See Booth & Criswell, "Molecular events underlying skeletal muscle atrophy and the development of effective countermeasures," *Int. J. Sports Med.* 18[4], s265–s269 (1997); Convertino, "Exercise as a countermeasure for physiological adaptation to prolonged spaceflight," *Med. Sci. Sports Exerc.* 28[8], 999–1014 (1996); and Leblanc et al., "Muscle atrophy during long duraction bed rest," *Int. J. Sports Med.* 18, s283–s285 (1997).

Reduced force development of skeletal muscle has been associated with six to eight percent decrements in volume of the lower limbs following flights longer than 3 months, according to Convertino, supra. Furthermore, because of the seven to twelve percent mineral loss in trabecular bone and throughout the spine after six to eight months of spaceflight, increased risk of bone fracture must be a concern for flight duration beyond 1 year. Id. As the future of long-term space habitation is inevitable, practical and effective measures to counter the debilitating effects of bone and muscle loss must be developed to allow astronauts to function normally in an environment without a 1-G gravity vector presence. This invention will further the objectives of the National Aeronautics and Space Administration (NASA) to develop successful exercise countermeasures for muscle atrophy and bone degradation during long-term microgravity habitation.

Recommendations to remedy the negative effects of microgravity on muscles and bones suggest that astronauts perform strengthening exercises while in space. See Booth, supra; Hoppeler et al., "Recommendations for muscle research in space,", *Int. J. Sports Med.,* 18: s280–s282 (1997); Hickson, et al., "Skeletal muscle fiber type, resistance training, and strength-related performance," *Med. Sci. Sports Exerc.,* 26[5]: 593–598 (1994); and Leblanc, supra. Such resistive exercises provide a load that is otherwise absent in space, presumably preserving musculoskeletal function. Many principles must be considered while designing an exercise device as a countermeasure for muscle atrophy due to disuse. Most importantly, load capabilities, constant force resistive output, and eccentric and concentric exercise capabilities should be the primary design goals of any resistive exercise device. (Eccentric exercise refers to the muscles' lengthening during a contraction, while concentric exercise refers to the muscles' shortening during a contraction. Both are essential during resistance training.) See Arnheim & Prentice, Principles of athletic training, *Ninth Ed.,* McGraw-Hill, New York (1997); Baechle, T. R., *Essentials of strength training and conditioning,* National Strength and Conditioning Assn. (1994); Colliander & Tesch, "Effects of eccentric and concentric muscle actions in resistance training," *Acta Physiol. Scand.* 140:31–39 (1990); and Harmen, "Resistance training modes: A biomechanical perspective," *J. Strength and cond. Res.* 4:59–65 (1994).

An extensive literature review has been performed on resistive exercise machines that have been designed for use in microgravity throughout the history of the space program. Numerous countermeasures for the negative physiological effects of microgravity on the muscluoskeletal system have been designed in the past, including exercise bikes, treadmills, and rubber band devices. See Convertine, supra; DiPramperno & Antonutto, "Cycling in space to simulate gravity," *Int. J. Sports Med.,* 18(?): s324–326 (1997); Essfeld, "The strategic role of exercise devices in manned spaceflight," *Micrograv. Sci. Tech,* 3:180–183 (1990); Kreitenberg, et al., "The 'Space Cycle' self powered human centrifuge: A proposed countermeasure for prolonged human spaceflight," *Aviat. Space Environ. Med.* 69:66–72 (1998); and McArdle, supra. However, while these exercise devices provide essential aerobic activity, they lack the ability to provide the necessary resistive forces on muscles and bones to replace the gravity vector of Earth. The latest space countermeasures also use pneumatics or hydraulics for resistive exercise; however, these means of resistance often result in stammered movement patterns during exercise, as noted by Essfeld, supra. (Due to the nature of these devices, range of motion movements during exercise are not smooth.)

Furthermore, most hydraulic machines provide concentric muscle contractions, but lack the essential eccentric contractions during exercise. Id. Both muscle lengthening and shortening during contractions are desirable. Although rubber band devices do provide anaerobic concentric and eccentric resistive forces, they do not provide the measurable constant quantitative forces on the muscles that are necessary for optimal muscle maintenance. Additional exercise devices, such as the exercise ergometers, use dampers or friction to produce resistance concentrically, but require power to operate; however, power availability is limited on space flights. With a reported energy budget for the entire space station in the range of 70 kW and only 10 to 15 kW available for scientific experiments, the use of such powered motors is infeasible. See, e.g., Hoppeler, supra.

U.S. Pat. No. 4,208,049 discloses a "multi-functional exercising device" employing a number of constant load springs, which can be chosen individually or in combined groups to provide a selected constant load force on a foot or hand grip, movable bar or other mechanism. The force can be exerted in both directions of travel. The unit is large and bulky.

U.S. Pat. No. 5,226,867 discloses a user-manipulated modular exercise machine with two reel assemblies, each including a spirally-wound spring which applies to the reel a reactive torque of changing magnitude as the reel rotates in response to pulling input forces applied to a pull-cord by the user. A cam-operated spring compensating mechanism provides for essentially constant force during operations in various exercise modes.

U.S. Pat. No. 5,733,231 discloses an exercise apparatus including a number of inelastic, retractable cords, each having a handgrip. Retracting mechanisms are provided for retracting the cords, and separate resistance mechanisms are provided for each cord. Removable disk resistance units can be added to increase the resistance force, which can be made essentially constant. The units can be attached to a belt worn by the user, or in various other exercise devices.

U.S. Pat. No. 4,944,511 discloses a small "adjustable resilient reel exerciser" which includes right and left reels with their own foot pads, cords and hand grips. Outward pulling on the cords is resisted by spring packs containing clock-type coil springs, which can be adjusted to the same initial tension. The spring packs can be "stacked" on one another to vary the resistive force applied to the reels. The units can be used in exercise devices such as rowing machines. There is no suggestion of a constant force device.

U.S. Pat. No. 6,123,649 discloses a bulky treadmill having a resistance device attached to the frame and connectible to, e.g., the user's legs, to provide a constant force resistance from the rear of the body while exercising.

U.S. Pat. No. 6,099,447 discloses an exercise belt for exercising the upper body, with cable retracting devices attached thereto. The cable retracting devices include coil springs whose tension is adjustable, but there is no mention of constant force devices. The ends of the cables include handles which may be weighted with detachable weights.

U.S. Pat. No. 5,540,642 discloses an aerobic exercise device including a platform which contains adjustable resistance devices from which cables can be withdrawn by the user in the course of exercising. There is no mention of constant force devices. The platform can be heavily weighted to increase stability.

U.S. Pat. No. 5,509,873 discloses an exercise device providing adjustable resistance through handles and retractable cords for the user's hands. The device is worn on a belt. Two types of adjustable tension devices are disclosed, but there is no mention of constant force devices.

U.S. Pat. No. 3,596,907 discloses an exercise device including an elongated flexible member for mounting within a frame. Movement of the flexible member with respect to the frame is opposed by a force which gradually increases to a predetermined level, then remains at that level. The force is provided by a combination of friction and springs. The amount of predetermined force is adjustable. No significant force opposes the relative movement of the flexible member in the opposite direction.

U.S. Pat. No. 1,139,126 discloses an exercise machine using springs and friction to create an adjustable resistance against which the user exerts force by means of a cable or the like. The machine can be used as part of a rowing machine. There is no mention of a constant force device.

A "constant force" spring can be defined as "a roll of pre-stressed strip which exerts a nearly constant restraining force to resist uncoiling." The force is stated to be constant because the change in radius of the curvature is constant. This is correct if the change in coil diameter due to buildup is disregarded. Constant and variable force springs are discussed in U.S. Pat. No. 6,149,094, which discloses a constant torque spring motor. FIGS. 8 and 9 of that patent illustrate the method for winding constant torque springs. The constant torque spring motor is a sophisticated, compact device which includes a take-up drum, and usually a larger diameter output drum, mounted on two separate axes. The spring itself is mounted upon the storage drum, which is free to rotate, while its opposite end is attached to the output drum. The spring coil is pulled straight, then wound onto the output drum by bending it against its natural curvature, thus storing energy in the reverse-coiled spring. When the output drum is released, the spring returns to its preset form, rewinding itself on the storage drum and rotating the output drum, thus imparting moment. The nearly constant torque provided results from the spring, which has been stressed sequentially during back-bending onto the output drum, releasing energy as it returns to the storage drum.

The Johnson Space Center Exercise Physiology Laboratory in Houston, Tex. has been evaluating the Interim Resistive Exercise Device (IRED) for use on the International Space Station (ISS) since about 1997. The resistive forces provided by the IRED are provided by "flex packs" which are composed of bungee and rubberband-type material. The IRED is capable of providing eccentric and concentric loading on the muscles during exercise; however, the loads are not constant throughout the entire range of motion of an exercise. Furthermore, to achieve a constant 1:1 eccentric:concentric ratio of exercise, the IRED will require the use of power. To date, there is no known gravity-independent resistive exercise unit that adheres to the requirements to provide a constant eccentric and concentric force during exercise. A need remains in the art for an apparatus that is capable of providing gravity-independent means of producing a measurable constant force, both eccentrically and concentrically, during exercise.

SUMMARY OF THE INVENTION

It is an object of the present invention to provide apparatus that is capable of providing a gravity-independent, measurable constant force both eccentrically and concentrically during exercise in terrestrial, microgravity and non-gravity environments.

It is also an object of this invention to provide apparatus that is capable of providing a gravity-independent, measurable constant force eccentrically and concentrically during exercise in any terrestrial or non-terrestrial environment, with or without the presence of gravity.

It is also an object of this invention to provide apparatus which can be used as a home gym for personal use, or as a supplement for rehabilitation programs.

The present invention will contribute to the development of practical and useful exercise countermeasures to muscle and bone atrophy during extended periods of inactivity or microgravity as a novel resistive exercise machine, the Constant Force Resistance Exercise Unit (CFREU). Unlike past and current countermeasure devices, the CFREU is designed to exercise muscle groups at a constant rate, both concentrically and eccentrically, throughout an entire range of motion during exercise.

In accordance with the present invention, a constant force resistive device is provided, comprising:

a hollow body containing:

at least one modular resistive pack, each of the pack(s) containing at least one constant torque spring, with each spring wound upon a separate storage drum within the pack, and each spring within the pack(s) having the free end mechanically attachable to a single output drum within the pack(s);

each output drum having mechanical means for connection to an output shaft;

which output shaft is mechanically connected to a cable drum having a cable which can be withdrawn to rotate the drum, with mechanical selection means provided for connecting any or all of the springs of the resistive pack(s) to the output shaft, thereby providing resistance to the withdrawal of a cable wound upon the cable drum.

The constant torque springs are flat coil springs wound according to their normal curvature upon the storage drums, and wound onto the single output drum(s) opposite their normal curvature. The hollow body can be configured to hold a plurality of modular resistive packs, with the output shaft and cable drum protruding outside the surface of the hollow body.

Each of the storage drums are preferably enclosed within the modular resistive pack(s). Each of the modular packs comprise an output shaft attached to the output drum and adapted for mechanical interconnection with the shafts of other adjacent packs so as to form a unitary output shaft, to which any of the packs can be engaged by operation of selection means.

Mechanical selection means for engaging the modular packs and their springs with the output shafts comprise plunger means which are removably connectible to the output drum of each of the packs to connect any of these drums to the output shaft and thus permit engagement of any or all of the modular packs with the output shaft. The plunger means can comprise spring-loaded plungers which are manually adjustable to engage the output shaft.

Further in accordance with the invention, each modular resistive pack can have an output drum which is mechanically attached to a common shaft, this shaft being mechanically connected to a cable drum having a cable which can be withdrawn to rotate the drum against the resistive force of the springs therein. The diameter of the cable drum and/or output drum(s) can be varied to vary the amount of resistive force offered by the modular packs which are engaged with the output shaft. Preferably, a plurality of modular packs and a cable drum of suitable diameter are provided so that resistive forces can be selected of at least about five pounds, preferably from about ten to about 300 pounds.

Still further in accordance with the invention, an alternate embodiment is provided wherein each constant torque spring in each of the modular resistive packs can be individually engaged or disengaged by lever-and-cam-actuated selection means which are adapted to removably connect and disconnect the output ends of any of the constant torque springs to the output drums of their respective packs. With this system, a plurality of modular packs and a cable drum mechanism can be adapted to provide resistive forces upon the cable of at least about five pounds, preferably in the range of from about five to about 500 pounds.

In both embodiments, the cable drums can be fitted with connection means such as rings or handles for a user to exert tension upon the cable in the course of exercising. Furthermore, each embodiment includes means for removably attaching at least one surface of the hollow body to at least one surface of a structure for use.

In either embodiment, the modular resistive packs can each comprise from one to about eight constant torque springs. In one preferred embodiment, the modular packs contain an output drum and one or two storage drums with the constant torque springs operationally connected therebetween, all components preferably being enclosed within the modular pack. In another embodiment, the packs comprise from about four to about eight storage drums spaced radially about the storage drum, again with constant torque springs operationally connected between the storage drums and the output drum.

In the embodiments with more than two storage drums and constant torque springs per modular pack, each output drum can be mechanically attached to a single output shaft, and each of the springs of each modular pack can be independently and separately engaged with the output drum of its respective pack to provide resistive force to the output shaft. In this embodiment, the springs can be selectively engaged or disengaged by lever-and-cam actuated selection means in which each incremental movement of the lever moves the cam means to expose a selection slot on the output drum and attach the output end of one of the springs to that selection slot. As with the embodiments above, the output shaft is mechanically connected to a cable drum having a cable which can be withdrawn in opposition to the resistive force of the engaged springs and packs. The cable can be directed by mechanical means comprising idler pulleys and roller means to suit the needs of the user.

Still further in accordance with the invention, a modular resistive pack is provided which comprises at least about four storage drums spaced radially about a central output drum, with each storage drum having a flat coil spring wound thereon according to its natural curvature, and means for selectively engaging or disengaging each spring to the output drum to be wound thereon opposite to the natural curvature of the springs as the output drum is rotated, plus means for connecting the output drum to an output shaft. The selection means are preferably lever-and-cam-actuated devices for removably attaching and detaching the output ends of the individual springs to the output drum.

The CFREU includes one trunk, generally a plurality of "resistive packs", and a cable that is used during exercise. The unit essentially resembles a weight stack of a standard resistive exercise machine; however, because free weights are useless in microgravity, the constant resistive forces of the CFREU are provided by sets of constant torque springs that are arranged in modular resistive packs within the trunk.

The present invention allows for the following:

Ability to allow both eccentric and concentric muscle contraction during exercise;

Ability to provide a constant force over the entire range of motion of an exercise;

Ability to allow multiple exercises to be performed, thus maximizing a complete body muscle strengthening routine;

Safe to use, easy to operate during exercise, and uses no power to operate;

Accommodates various body heights and weights;

Resistive Packs are modular to allow for upgrades and exchanges; and

Can be used in microgravity and low-gravity environments.

The CFREU trunk can house any number of force packs that may be engaged or disengaged at any time to obtain the desired amount of resistive forces during exercise. A cable drum with a cable can be attached to the same shaft as the engaged force packs. The user can attach accessories such as leg cuffs, squat bars, harnesses, and handgrips to exercise various muscles. Additionally, the cable may be designed to split into two cable extensions so as to provide the user with bilateral exercise capabilities.

The resistive force provided by each resistive pack is based upon the activation of one or more constant torque springs. A constant torque spring is made up of a specially stressed constant force spring that travels between two drums. The spring is wound on a storage drum according to its natural curvature and is reverse wound to its natural curvature onto an output drum. The springs are rated in terms of torque (in-lbs.); therefore, the amount of force output depends on the moment arm of its output drum and the respective cable drum. In contrast to constant torque springs, constant force springs are simple coil springs which are wound upon a single storage spool and withdrawn directly from that spool. U.S. Pat. No. 4,208,049, columns ¾, explains the resulting resistive forces. Briefly, since the springs are rated in terms of torque, the force exerted on the user during exercise is given by F=M/r, where M=the sum of all torques from all springs in the engaged output drums, r=the radius of the cable drum or output drum, and F=force on user. The desired amount of resistive force encountered by the user should take into consideration the spring torque rating, inherent in the springs after manufacturing, and the diameter(s) of cable drums and output drums that will be used. Based upon the equation above, the total resistive force will vary according to the length of the moment arm (r=radius) of the cable drum and output drum(s). Since the spring resistive force felt by the user is directly related to its moment arm, changing the diameters of the cable and/or output drums will effectively change the force experienced by the user with a given set of springs engaged. Since the relation is inverse, decreasing the drum diameters will increase the resistive force, while increasing these diameters will decrease the resistive force.

The resistive packs are designed to be modular, so if a spring were to fatigue and break inside its resistive pack, the pack could be unlocked from its base and safely exchanged for a new pack. Although the springs themselves may be exchanged or replaced within the packs, it is preferred to replace the modular packs for convenience. Easy exchangeability of the resistive packs also allows for pack upgrades to higher or lower resistive forces specific to individual exercise preferences. Resistive packs can be held together in series by coupling each resistive pack output shaft to the next. Examples of constant torque springs are disclosed in U.S. Pat. No. 4,208,049, which is incorporated herein by reference.

The resistive force provided by each resistive pack varies per pack specification. The CFREU resistive packs are designed so that the user can select one or more at one time to achieve the desired amount of resistive forces during a given exercise. Additionally, the total resistive force output of each resistive pack can vary according to individual specifications. With the addition of more springs or resistive packs, the CFREU can provide an essentially unlimited amount of resistive force which can be utilized for eccentric/concentric exercise.

In addition to uses within the space program, the compact resistive packs of the CFREU allow the unit to be small enough for easy use as a home gym for personal use, or as a supplement for rehabilitation programs. Such resistive packs may be obtained individually by a consumer, and may be changed conveniently out of the CFREU according to the desired exercise regimen. Thus, the resistive packs replace the need for expensive, heavy, and bulky traditional weight plates. The CFREU may be employed by hospitals, rehabilitation and physical therapy clinics, and other related professional businesses.

The CFREU includes a series of resistive packs that can be coupled to each other by the interconnection of each pack's output shaft. Thus, when all the resistive packs are coupled together, one complete output shaft is formed that runs the length of the CFREU. At the end(s) of the output shaft, at least one cable drum is attached that provides at least one cable to the user for use during exercise. Cable drums and/or pack output drums of different sizes can be provided to affect the amount of resistive force exerted by a given set of constant torque springs. Each resistive pack has a selection plunger device that is used to engage or disengage that pack. To engage a resistive pack for use during exercise, the user inserts the selection plunger through the selection mechanism and engages the output shaft of the individual pack. As the selection mechanism is directly attached to the output drum, this causes the output drum to engage to the output shaft, thus putting the output drum into motion. Since the constant torque springs are attached to the output drum, the rotation of the output drum activates the constant torque springs to reverse rewind around the output drum, thus translating the spring forces along the output shaft to the cable drum. Because the cable drum is attached to the output shaft, the user receives the selected resistive packs' combined resistive forces during exercise when pulling on the cable. When a resistive pack is not in use (disengaged), the plunger device rests embedded in the selection mechanism, but is not inserted into the output shaft. Since the selection mechanism is not engaged, the output shaft simply rotates while the output drum remains stationary.

Each constant torque spring is housed or wound on its own storage drum, which rotates on its own storage drum shaft within each resistive pack. If a spring were to fatigue and break inside its pack, the pack could be unlocked from its base within the trunk and safely exchanged for a new pack. Easy exchangeability of the resistive packs also allows for convenient resistive pack exchanges to provide higher or lower resistive forces specific to individual exercise preferences.

Each resistive pack has a mechanical selection mechanism, preferably employing spring-loaded retractable plungers, that allows the user to select which resistive pack(s) he/she would like to use during exercise. The selection mechanism allows for any one or more resistive packs to be selected at one time, thus providing many combinations of resistive force available from the CFREU. The force is exerted as a resistance to withdrawal of the cable by the user, and remains essentially constant during the full range of motion for a given combination of resistive force packs.

The user can attach conventional exercise accessories such as leg cuffs, squat bar, harness, and handgrips to the cable(s) for exercising various muscle groups. The CFREU can also be incorporated into full body cable and pulley exercise systems.

BRIEF DESCRIPTION OF THE DRAWINGS

Reference will now be made to the accompanying drawings, which form a part of the specification and are to be read in conjunction therewith, wherein like parts are designated by like reference numerals in the various views, and wherein.

Additional objects and advantages of the invention will become apparent from the following detailed description, including the drawings and appended claims.

DETAILED DESCRIPTION OF PREFERRED EMBODIMENTS

Although a primary use of the disclosed invention is in spacecraft, for convenience a terrestrial frame of reference will be adopted, with "up" commonly defined as the direction opposite to the existing gravitational field, "down" being toward that field, etc. With regard to the apparatus disclosed, the bottom will be the surface normally placed downward, or having brackets for attachment to a surface, the front will be the side where cables and the like emerge, and the back the side opposite therefrom. Right and left will be defined for a person facing the apparatus from the front, while it is "topside up". The term "and/or" may be used in its conventional sense, wherein "A and/or B" signifies either A or B alone, or both together.

Figure 1:
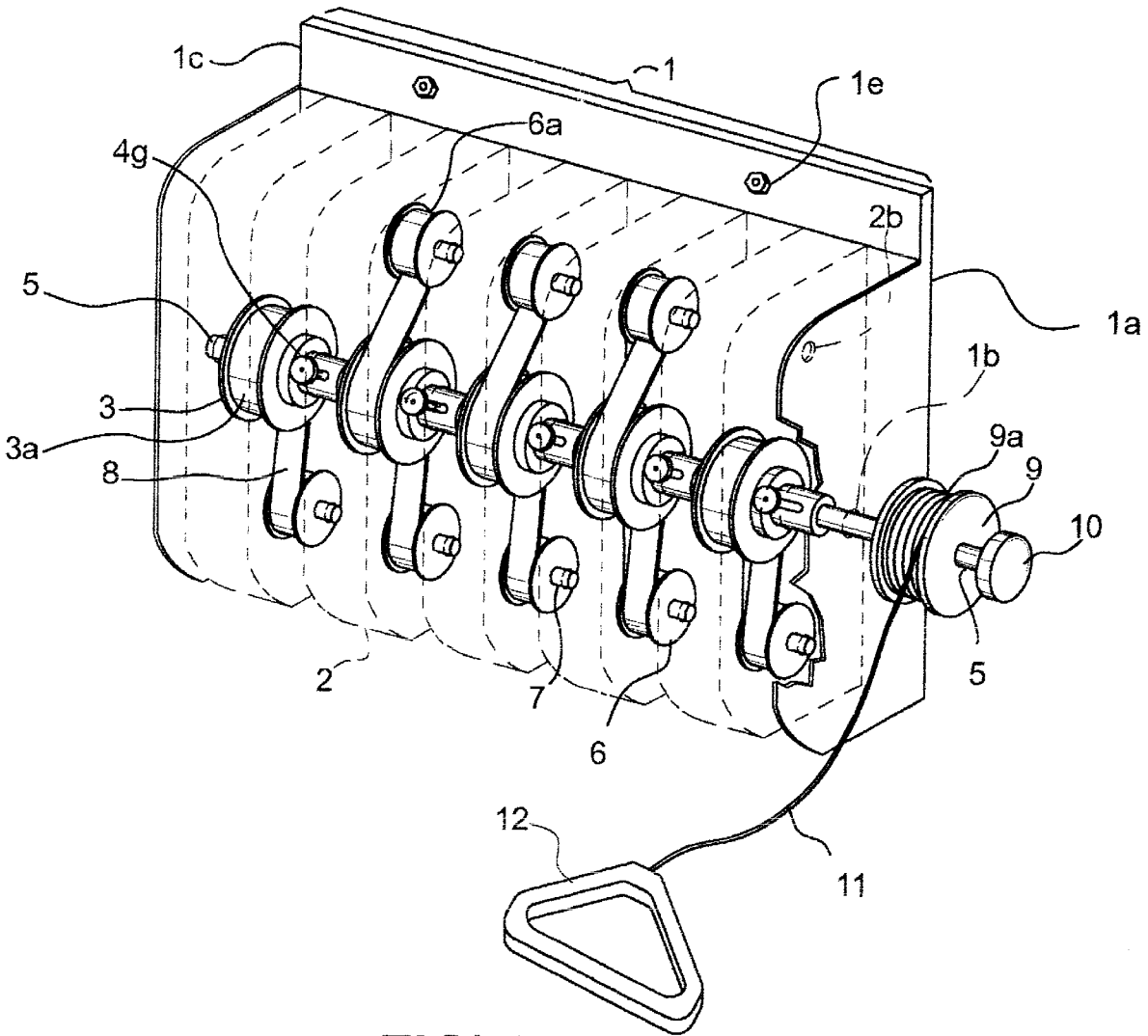
FIG. 1 is a cutaway view of the full CFREU complete with attachments and mechanical parts.
Figure 3:
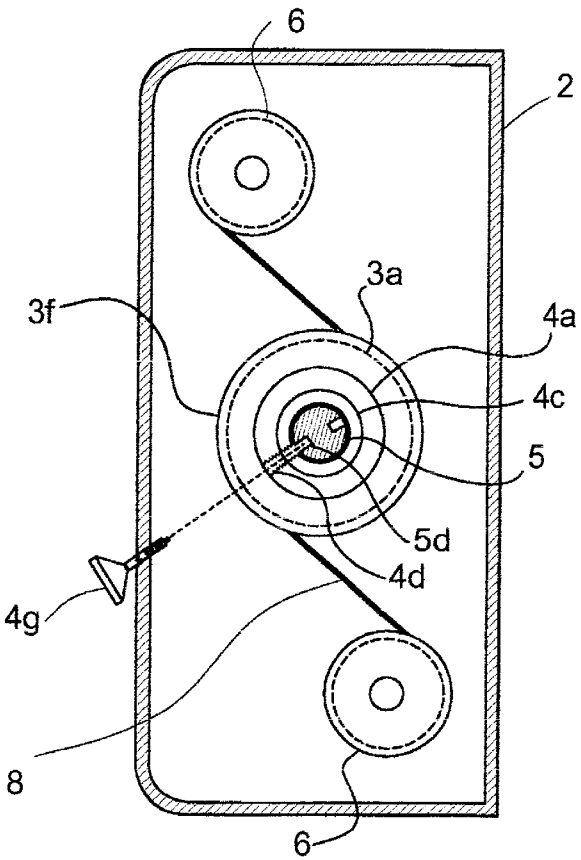
FIG. 3 is a cutaway side view of a resistive pack.
Figure 2:
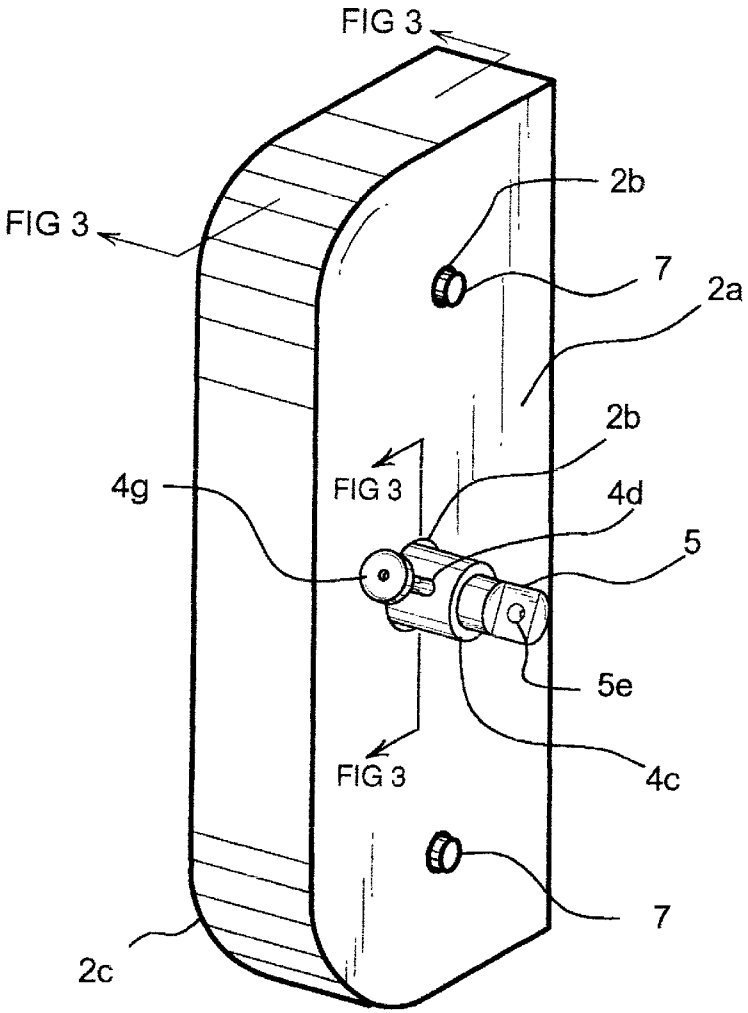
FIG. 2 is a side perspective view of a resistive pack.

Referring now to the drawings in more detail, the exercise device of the present invention is designed by numeral 1 in FIGS. 1 to 3 of the drawings. The device 1, which may be referred to as a CFREU, comprises a hollow trunk body 1*a* containing components 2, 2*b*, 3, 3*a*, 3*b*, 3*c*, 3*d*, 3*e*, 4, 4*a*, 4*b*, 4*c*, 4*d*, 4*e*, 5, 5*a*, 5*b*, 5*c*, 6, 6*a*, 6*b*, 6*c*, 6*d*, 7, 7*a* and 8. Parts 9, 9*a*, 10, 11 and 12 are housed on the outside of trunk 1*a* of device 1 and are considered part of device 1. The body of device 1 is normally oriented horizontally (i.e., with base 1*c* parallel to a floor or other surface) when it is positioned for operation as an exercise device, and secured to the surface with suitable mechanical fasteners 1*e*.

Mounted within the device 1 is a series of one or more (i.e., any number of) modular resistive pack(s) 2 (flat volumes enclosed by dotted lines) that contain one or more constant torque springs 8 (generally two), each spring housed or wound on its respective storage drum 6, (having spring channels 6*a*) with the end of each spring attached by a screw or other suitable mechanical attachment means (not shown) onto the pack's output drum 3, having spring channel 3*a*. The springs can be fabricated of typical spring steels available commercially, or other suitable materials. Spring steels can be stainless steel or high carbon steel; "Bartex" has been identified as a commercial high-carbon spring steel. Commercial manufacturers of suitable springs include Vulcan Spring Co. of Telford, Pa.; Sandvik Spring of Scranton, Pa.; and the Tensator company of the United Kingdom. Each spring is wound upon its storage drum according to its natural curvature, and winds onto the output drum in a direction opposite to its natural curvature. This form of winding produces a constant resistance force when the cable is pulled. The resistive packs can have any suitable shape which facilitate their assembly together in the device. They can be substantially flat and rectangular, as shown in FIG. 2.

Figure 6:
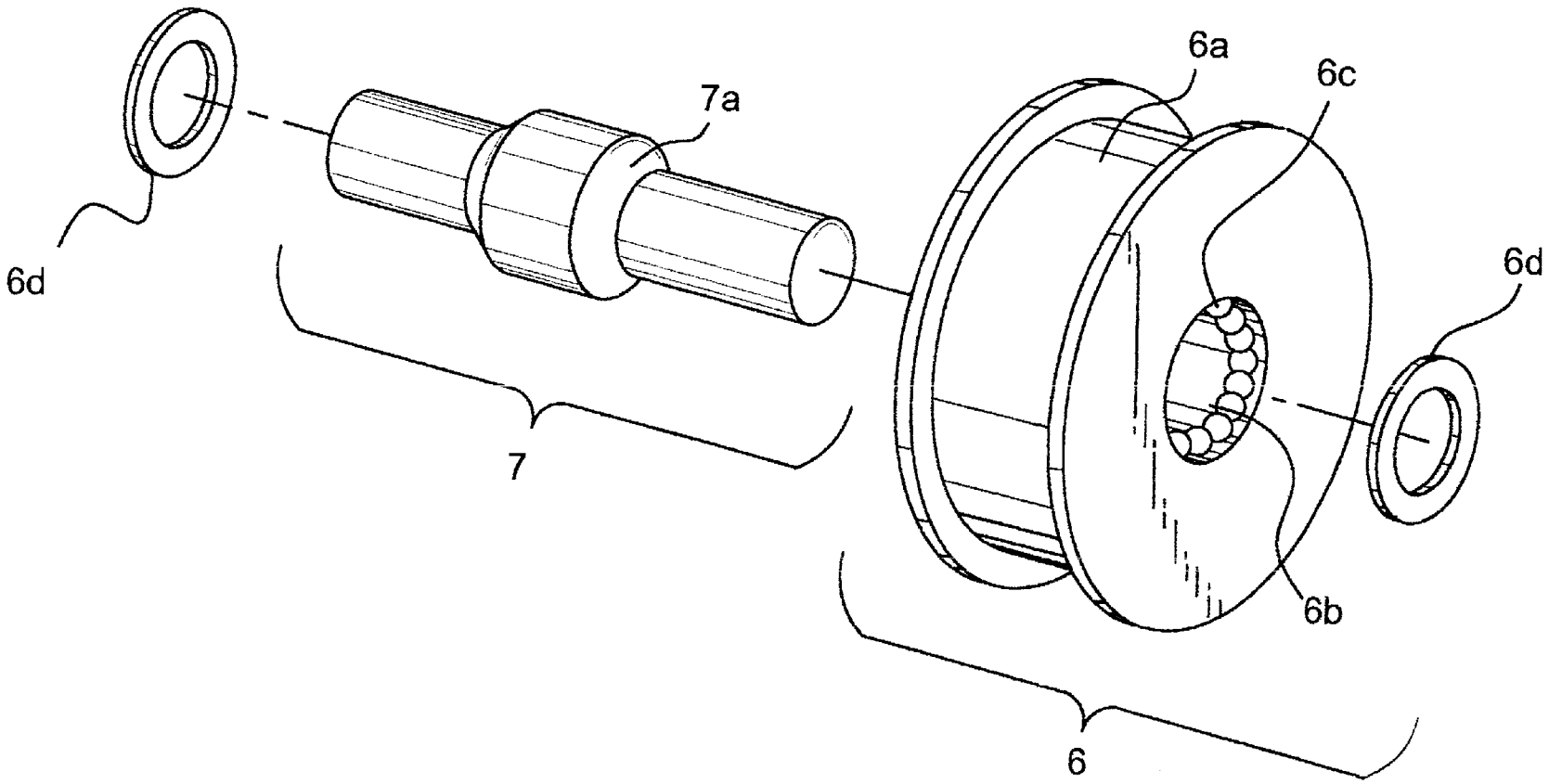
FIG. 6 is an exploded view of a storage drum and associated parts and shaft.

As shown in FIG. 6, each storage drum 6 is fixed by bearing guide 7*a*, mounting twin shaft bearings 6*c*, and bearing seals 6*d*, to its storage shaft 7, which is fastened mechanically to the side case surfaces 2*a* of the pack 2 through holes 2*b*, as shown in FIG. 2. Although pack 2 is shown as fully enclosed by surface 2*c*, as a minimum requirement there need only be sufficient case or brackets to mount the shafts 5 and 7 for the output and storage drums, respectively. Packs with such minimal case designs may be desirable for assembly into lightweight devices. Each pack 2 is fitted with a number of constant torque springs 8 (at least one, generally two) before inserting it into the CFREU 1 and coupling it to another pack 2. Resistive packs 2 can be fully enclosed (2*c*) with suitable strong, hard materials such as metals, alloys, plastics or composites, and can be made individually according to the user's specifications. A variety of suitable materials can be used for the structural components and moving parts of these devices, including alloys of steel, aluminum, magnesium and non-ferrous metals, and reinforced polymeric composites. For spacecraft applications, materials which are lightweight and strong are favored. Stock drive shafts, pulleys, drums and other mechanical parts are available commercially from Sterling Instrument Co. of Hyde Park, N.Y.

Figure 4:
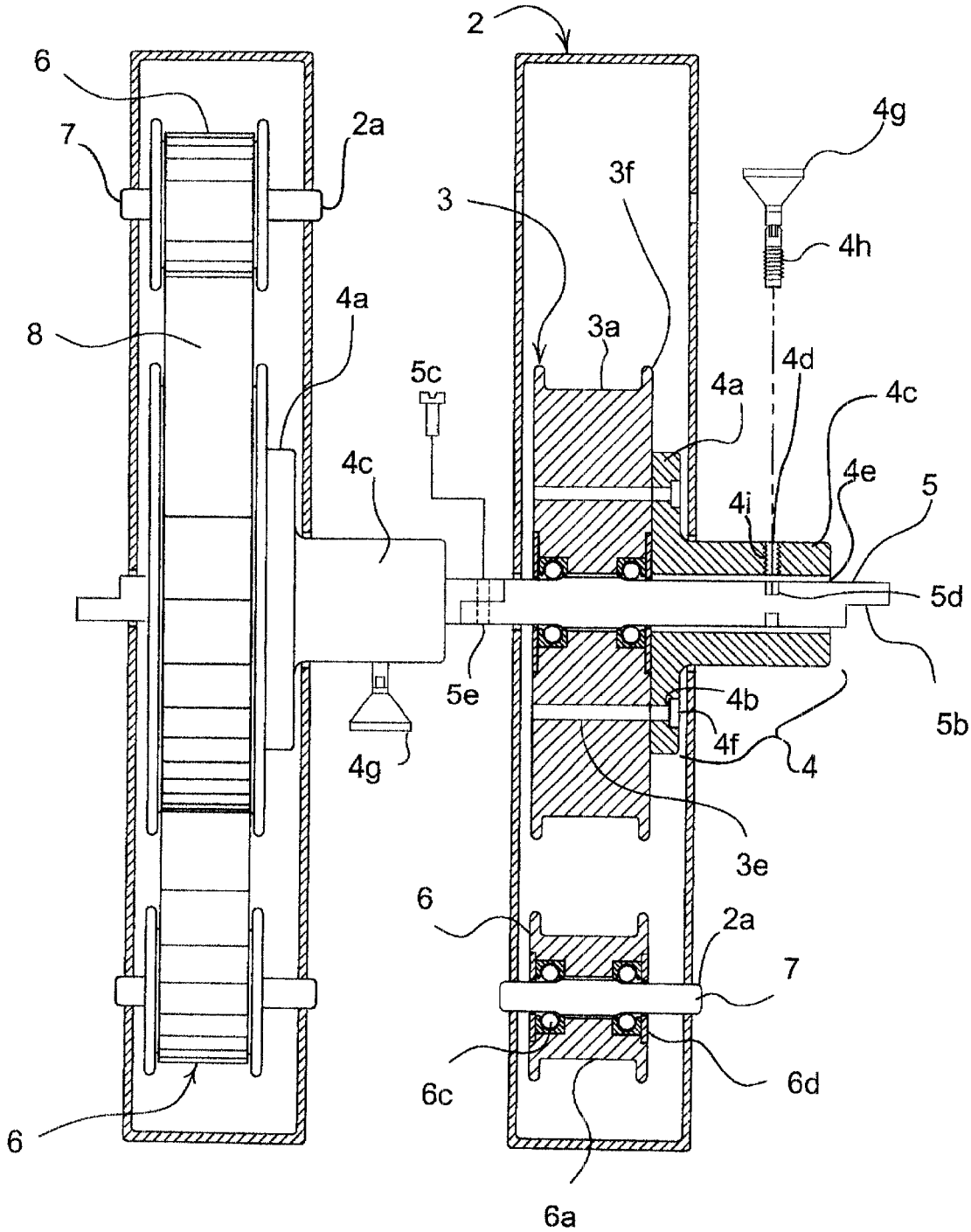
FIG. 4 is a partial or sectional frontal view of one resistive pack connected to another resistive pack.
Figure 5:
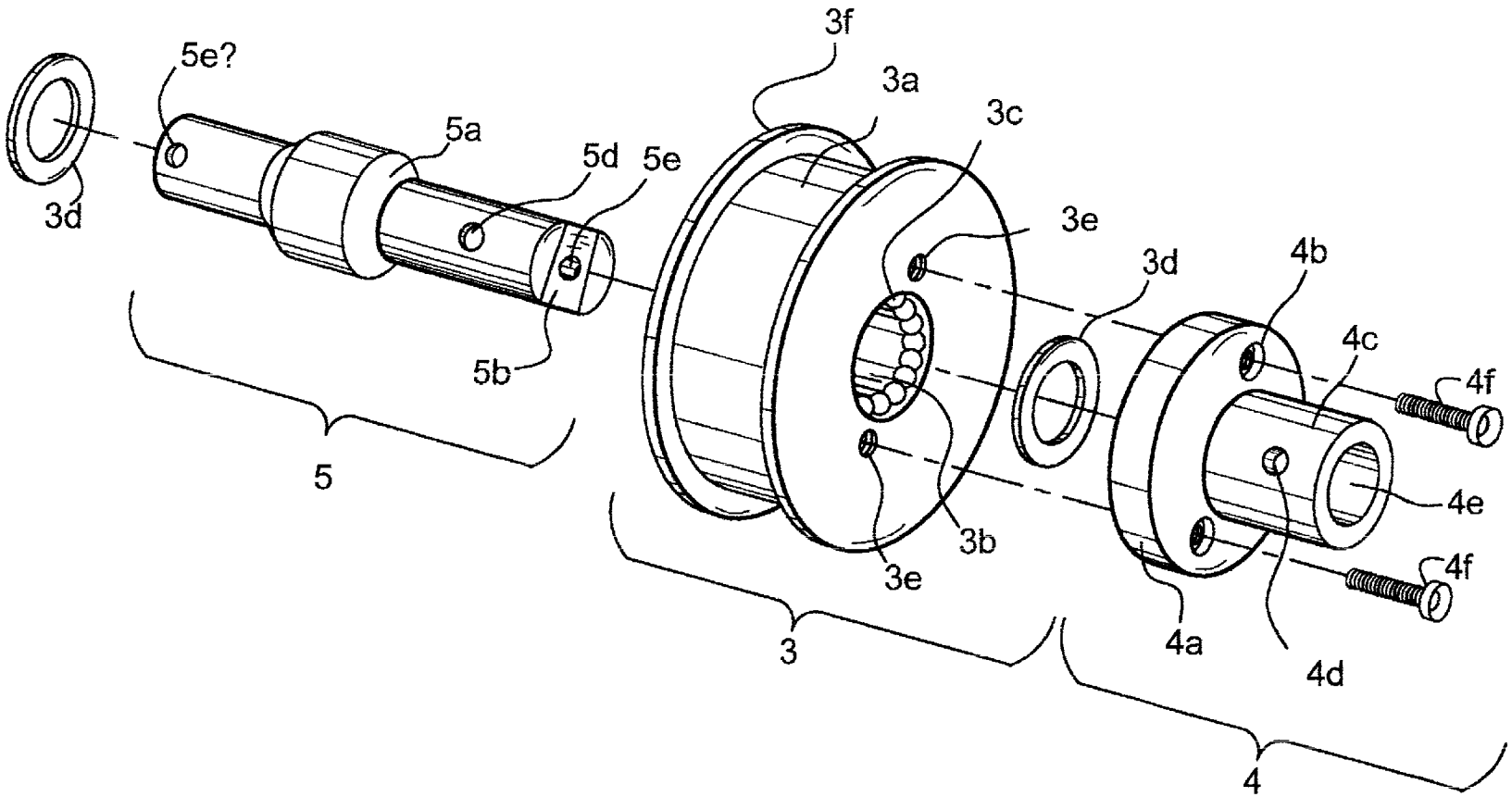
FIG. 5 is an exploded view of an output drum with selection mechanism, associated parts and output shaft.

As seen in FIGS. 2 and 3, extending horizontally through each pack 2, onward through the output drum 3 and outward from each side of the pack 2 (via hole 2*b*) runs an output shaft 5. As shown in FIGS. 4 and 5, the output drum 3 is rotably attached to its output shaft 5 and bearing supports 5*a* by means of the output shaft hole 3*b*, the twin output shaft bearings 3*c*, and the twin bearing seals 3*d*. Drum 3 can rotate around bearing supports 5*a*. Each individual output shaft 5 of each pack 2 fixedly attaches to the next output shaft 5 of the next adjacent force pack 2 by means of a standard bolt or setscrew (or other suitable mechanical fastener) 5*c* (shown in FIG. 4) and optional nut (not shown) through the transverse holes 5*e* in each attachment notch 5*b*. Each pack 2's output shaft 5 has a plunger hole 5*d* (FIG. 5) passing tranversely through the output shaft 5.

Operationally connected to the output shaft 5 at one end of device 1 (in FIG. 7) is the cable drum 9, having cable channel 9*a*. During exercise, the user pulls the cable 11, which is fixed at its end to the cable drum 9 by means of a screw or other suitable mechanical attaching means (not shown), thus rotating the output shaft 5. Handle 12 is attached to cable 11 for this purpose, and can be replaced with or connected to a variety of other connecting devices or fixtures to facilitate the use of the device for various types of exercise in many environments. The constant torque springs in the engaged resistive packs resist the rotation of output shaft 5 by cable drum 9 when cable 11 is pulled by the user. The springs retract naturally by rewinding around their storage drums, causing cable 11 to retract when released by the user.

As seen in FIGS. 2, 3, 4 and 5, fixedly secured to one side of the output drum 3 of each pack 2 is a hollow selection mechanism 4 which encloses shaft 5. The user actuates the selection mechanism 4 of each pack 2 by attaching the attachment flange 4*a* via attachment holes (4*b*) and bolts (or other suitable mechanical fasteners) 4*f* to the side of the output drum 3 through threaded holes 3*e*. The output shaft housing 4*c* portion of the selection mechanism 4 also houses the output shaft 5. The output shaft 5 runs through the selection mechanism shaft hole 4*e*. The attachment flange 4*a* is normally contained within the pack 2, while the selection mechanism output shaft housing 4*c* runs with the output shaft 5 through holes 2*b* in the side of the pack 2 and ends. The selection mechanism output shaft housing 4*c* has one plunger hole 4*d* designed to accomodate the perpendicular selection plunger 4*g* to engage output drum 3 with shaft 5. In FIG. 4, the plunger hole 4*d* is shown directly aligned with the output shaft selection mechanism attachment hole 5*d* in shaft 5.

To rotate the output shaft 5 for direct alignment of its plunger hole 5*d* with the selection mechanism plunger hole 4*d*, the user first deselects all resistive packs 2 by withdrawing their plungers from plunger holes 5*d* so the output shaft 5 can rotate freely. Next, the user rotates the selector knob 10, which is fixedly attached to the output shaft 5 outside case 1*a*, until the selection mechanism plunger hole 4*d* aligns with the output shaft plunger hole 5*d* in a particular pack. For each pack 2, the output shaft plunger hole 5*d* is machined with the same specifications so that when the user rotates the selector knob 10, all selection mechanism plunger holes 4*d* align properly with their respective output shaft plunger holes 5*d*.

To engage one pack to provide resistive forces during exercise, the selection plunger 4*g* (shown in simplified form in FIGS. 2 and 3) can be manually pushed completely through the selection mechanism housing 4*c*, plunger hole 4*d* and into the output shaft plunger hole 5*d*, thus operationally engaging the output drum 3 of that pack to the output shaft 5.

The selection mechanism plungers for each pack can be any suitable mechanical means of interconnecting the selection mechanism flanges 4*a*, selection mechanism housing 4*c* and output shafts 5, such as the simple pins illustrated in FIGS. 1, 2 and 3. However, to keep the plungers in place and operating reliably, improved devices such as the spring-loaded plungers 4*g* shown in FIGS. 1A through 1E and 4 can be used. As shown in FIG. 4 and other figures, the plungers 4*g* can be screwed into the selection mechanism plunger (threaded) hole 4*d* so that external threads 4*h* of the plunger 4*g* engage internal threads 4*i* of plunger hole 4*d*.

Figure 1A:
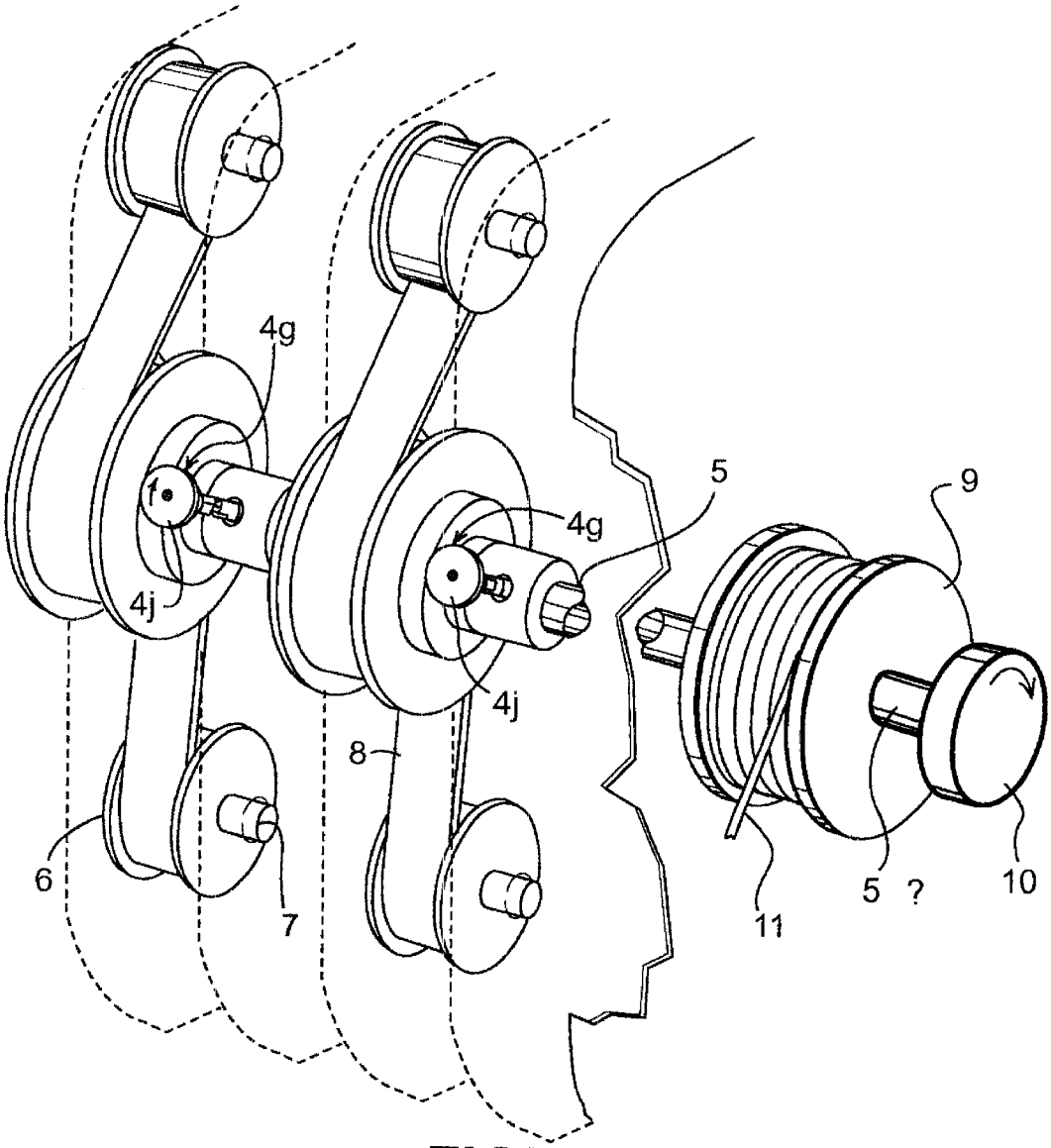
FIG. 1A is a partial cutaway view of the CFREU focusing on the selection mechanism.
Figure 1B:
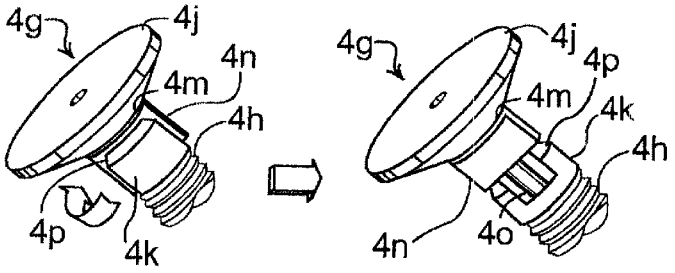
FIG. 1B is a perspective view illustrating spring-loaded plungers used in the selection mechanism, in two configurations.
Figure 1C:
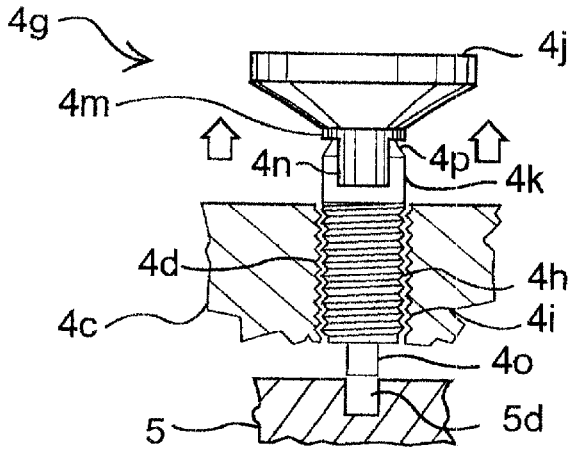
FIGS. 1C to 1E are side views illustrating the operation of the spring-loaded plungers of FIG. 1B.
Figure 1D:
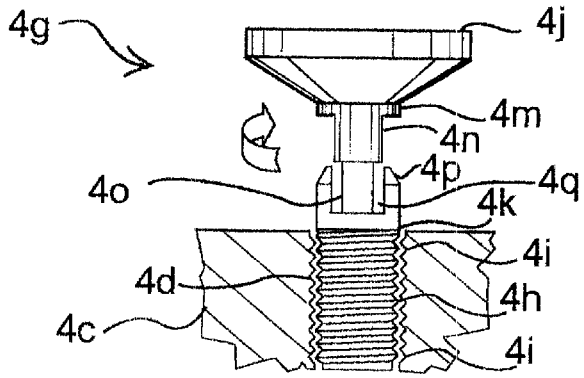
Figure 1E:
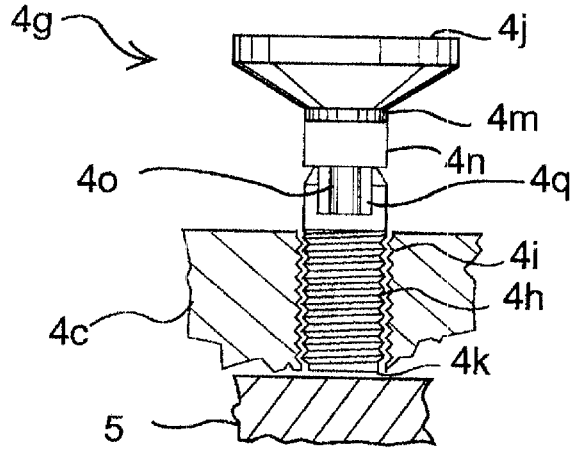

As shown in detail in FIGS. 1B through 1E, spring-loaded plungers 4*g* have a head or knob 4*j* and a body 4*k* with external threads 4*h*. Head 4*j* is attached to collar 4*m*, which has a flattened section 4*n* which fits within slot 4*q*. Head 4*j*, collar 4*m* and upper section 4*n* are normally held in the extended/engaged position of FIG. 1C, with plunger shaft 4*o* protruding from the bottom of the unit, by internal springs (not shown). Plunger shaft 4*o* enters plunger hole 5*d* (in shaft 5) when selection mechanism housing 4*c* aligns properly with shaft 5. As shown in FIGS. 1B, 1C and 1E, the spring-loaded plungers 4*g* have two stable positions—extended as in FIG. 1C (and FIG. 1B on left) and withdrawn as in 1E, to retract plunger shaft 4*o* and allow housing 4*c* to rotate freely about shaft 5.

In FIG. 1D (and in FIG. 1A, on left; FIG. 1B, on right), head 4*j* is lifted to free collar 4*m* from frictional contact (or mechanical detents, not shown) on bevelled upper end 4*p* of plunger body 4*k*. Head 4*j* can then be rotated (CW or CCW) as shown in FIG. 1D, with collar 4*m* and upper section 4*n* clear of slot 4*q* in body 4*k*, exposing the upper portion of plunger 4*o*. By rotating head 4*j* about ninety degrees from its previous position and releasing it, flattened section 4*n* can be positioned to rest upon bevelled upper portion 4*p* of body 4*k* (FIG. 1E), and is held in that position by the internal springs and (preferably) mechanical detents (not shown). In this retracted position, plunger shaft 4*o* is retracted into body 4*k* and does not contact shaft 5. A wide variety of suitable plungers are available from the MSC Industrial Supply Co. Of [Melville, Ala.]. The plunger used for prototypes of the present invention was listed as a "hex drive knob retractable locking plunger".

Figure 7:
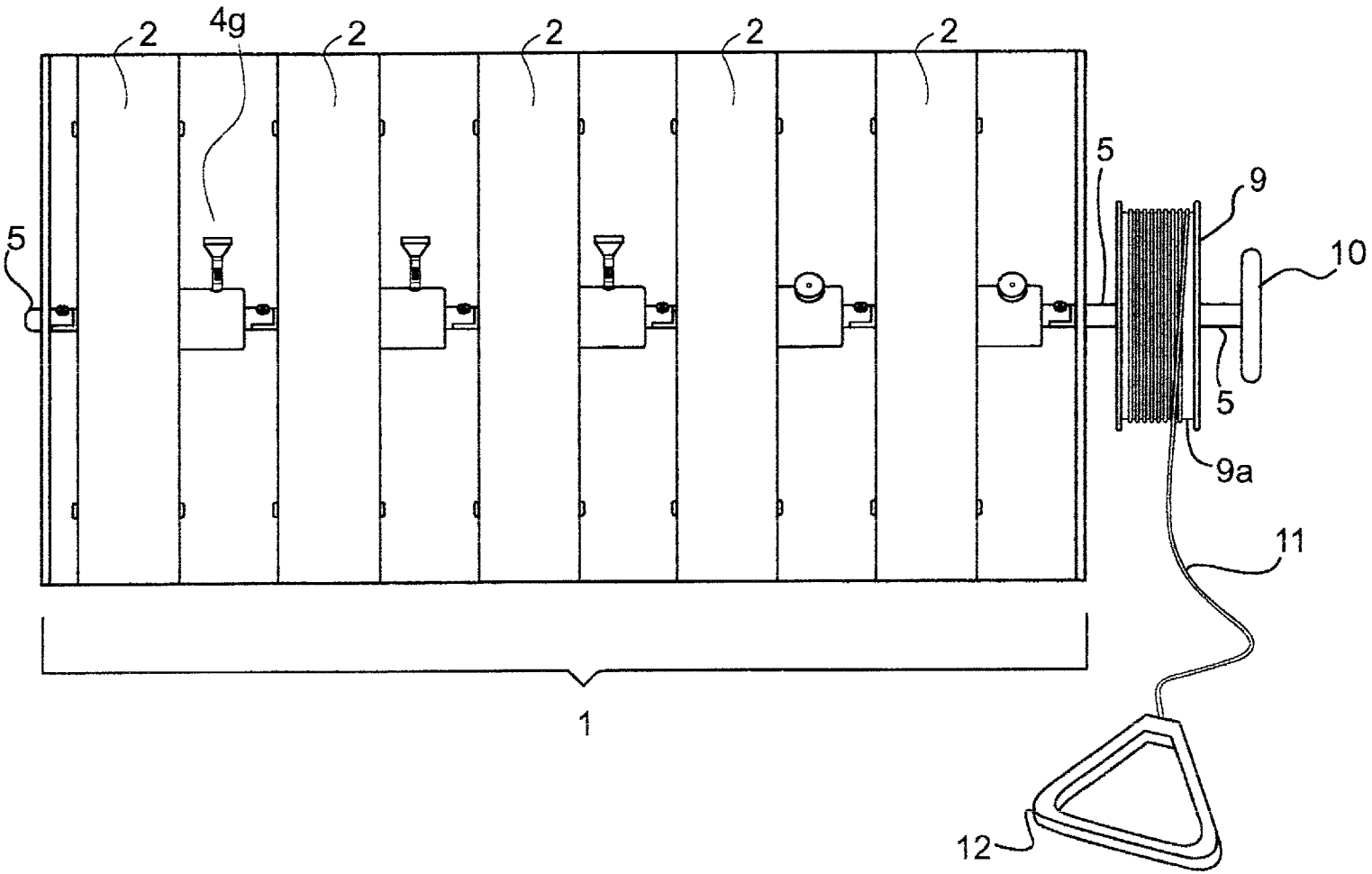
FIG. 7 is a top view of the CFREU with resistive packs, shafts and selection mechanisms exposed.

When the output drum 3 is operationally engaged with the output shaft 5 via the spring-loaded plunger 4*g*, the resistive forces of constant torque springs 8 in that pack are translated to the user during exercise when the user pulls on the cable 11, thus rotating the connected output shafts 5. One or more resistive packs 2 can be selected in this way to combine any given amount of constant torque spring 8 force during exercise. FIGS. 1A and 7 show (on right) plungers which are engaged to select their packs. To disengage the pack(s) from providing resistive forces, the user can manually pull the plunger shaft(s) 4*o* out of the output shaft plunger hole(s) 5*d*, leaving the plunger shafts to rest embedded in the plunger body 4*k* which is threaded into selection mechanism plunger hole, 4*d*. Thus, the output shaft 5 will rotate freely within the selection mechanism output shaft housing 4*c* of that pack.

Any number of resistive packs 2 can be coupled together through connections at 5*b* with bolts or mechanical fasteners 5*c* and housed within the hollow body 1*a* of the CFREU 1 to achieve the desired amount of force during exercise. FIG. 7 shows the system with the two packs on the right engaged (i.e., plungers extended), the three packs on the left disengaged (plungers retracted). The engaged plungers will rotate with housings 4*c* and shaft 5 as the device is used, while the disengaged plungers will remain in position as shaft 5 rotates within their housings.

The bottom plate 1*c* of the CFREU 1 should generally be affixed securely to the floor or wall during use. Base 1*c* can be secured to such surfaces by any suitable means, including mechanical fasteners 1*e*, magnetic catches, vacuum devices or even hook-and-loop fabric combinations such as VelcroR (only fasteners shown here). Portions of base 1*c* can be extended to form footrests for the user, thus pressing it against the adjacent surface by the force of gravity and/or the force exertec by the user on cable 11. In addition or as an alternative, trunk 1 can be fully encased in suitable strong materials and footrests provided on the upper surface to permit use of the device while it is held in position by the feet. Although FIG. 1 shows the packs 2 contained only by base 1*c* and side portions of outer case 1*a*, a hinged cover of any suitable material can be provided to cover the packs and their moving parts if desired. For large, heavy units of this embodiment and those described below, conventional retractable casters or engagement points for hand trucks can be provided for convenient movement (not shown).

Cable 11 can be connected to two or more cables for bilateral exercise of the arms or legs. Alternatively, two separate CFREU's can be set up for such bilateral exercises. The two units can be connected by a plate or other connecting device, or can be secured separately to a surface, as described above. Since the constant torque produced by the spring(s) 8 is converted to a constant force (upon pulling cable 11) by the moment arm of cable drum 9, the diameter of cable drum 9 will affect the resultant resistive force on cable 11. Smaller drums will produce more force, while larger drums (with larger moment arms, and thus more mechanical advantage) will produce less force. The devices of the invention can be produced with drums of various sizes, or provided with interchangeable drums to produce differing force levels from a given set of packs and springs.

Figure 8:
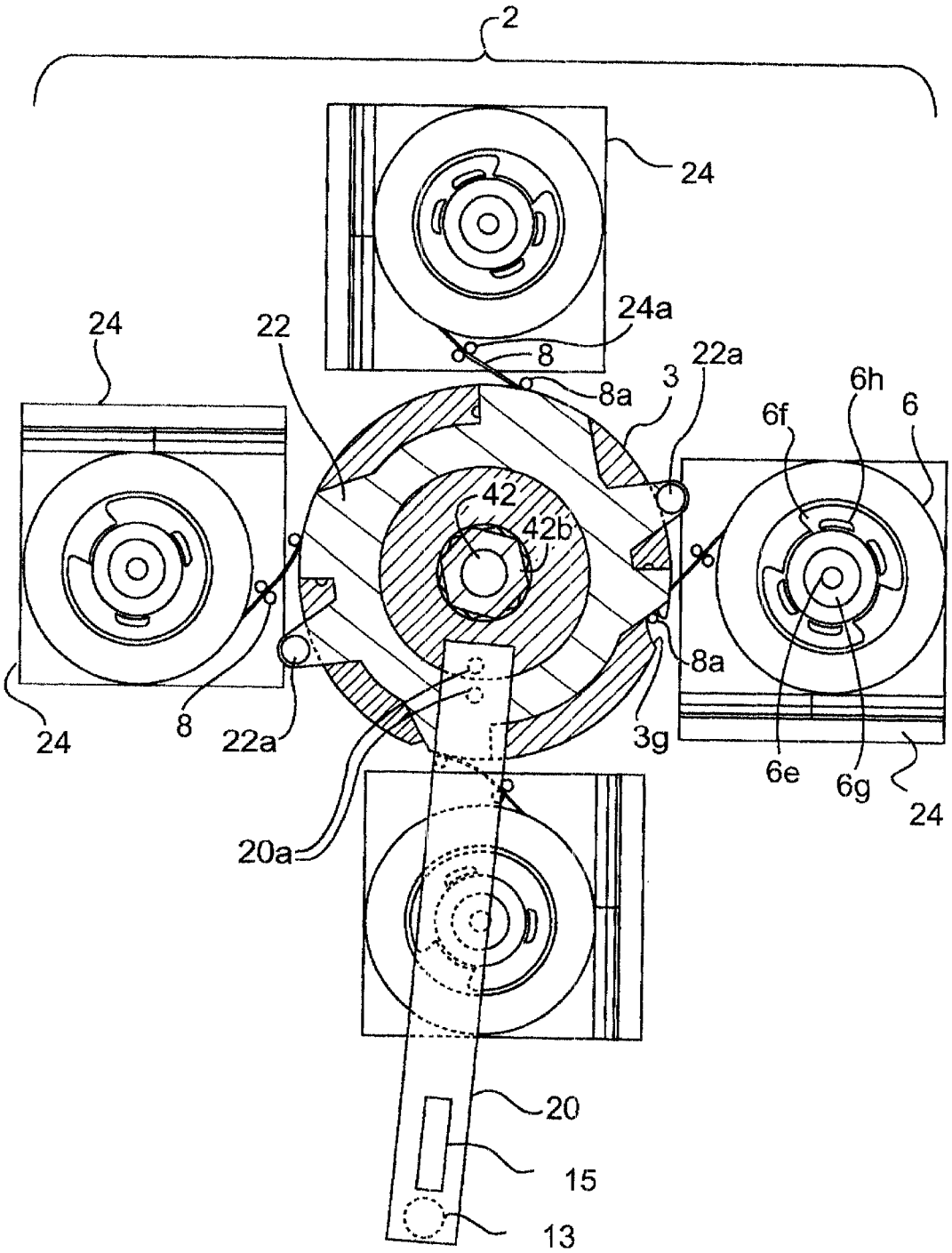
FIG. 8 is a top view of an alternative resistive pack and selection mechanism with one spring selected.
Figure 8A:
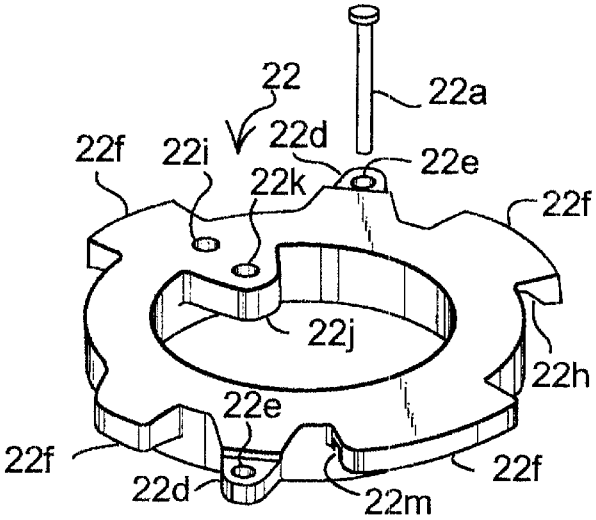
FIGS. 8A–8C provide an exploded view of the upper and lower cams and output drum.
Figure 8B:
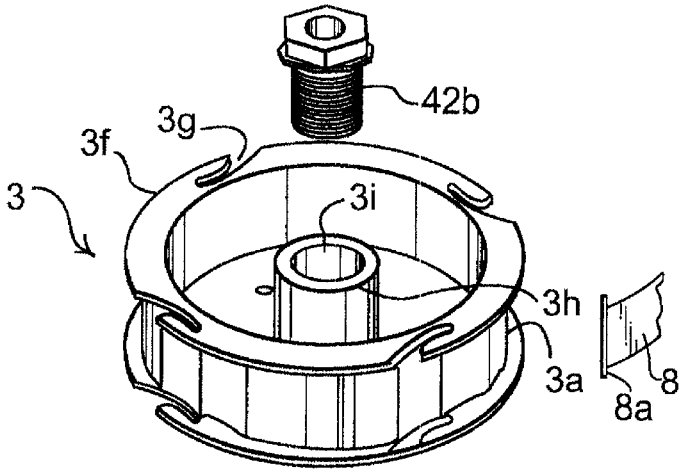
Figure 8C:
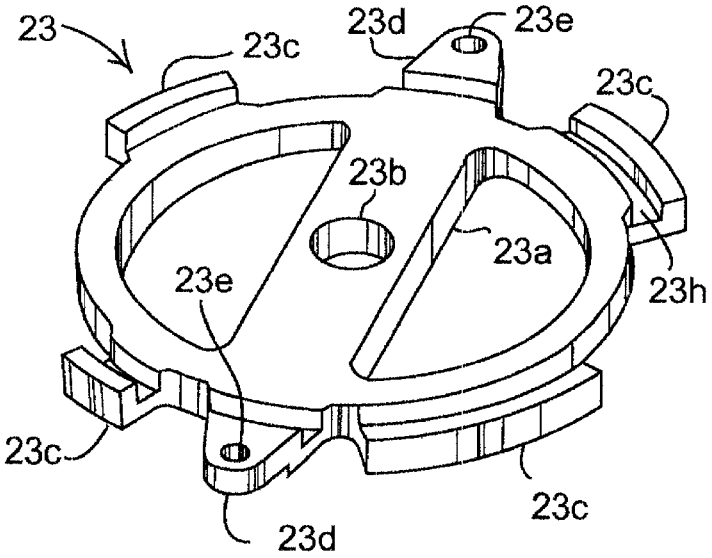
Figure 8D:
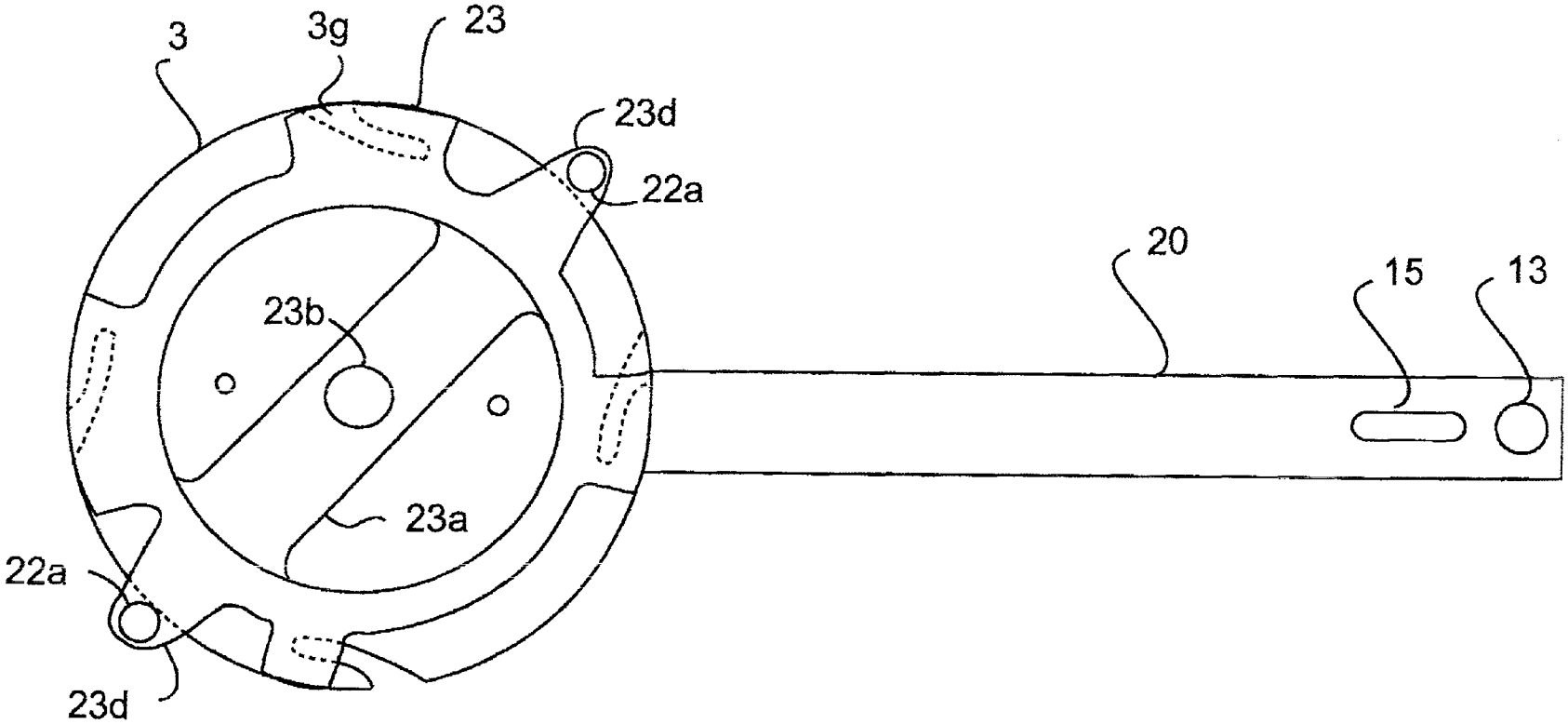
FIG. 8D is a bottom view of the assembled cams-output drum assembly with lever.
Figure 10:
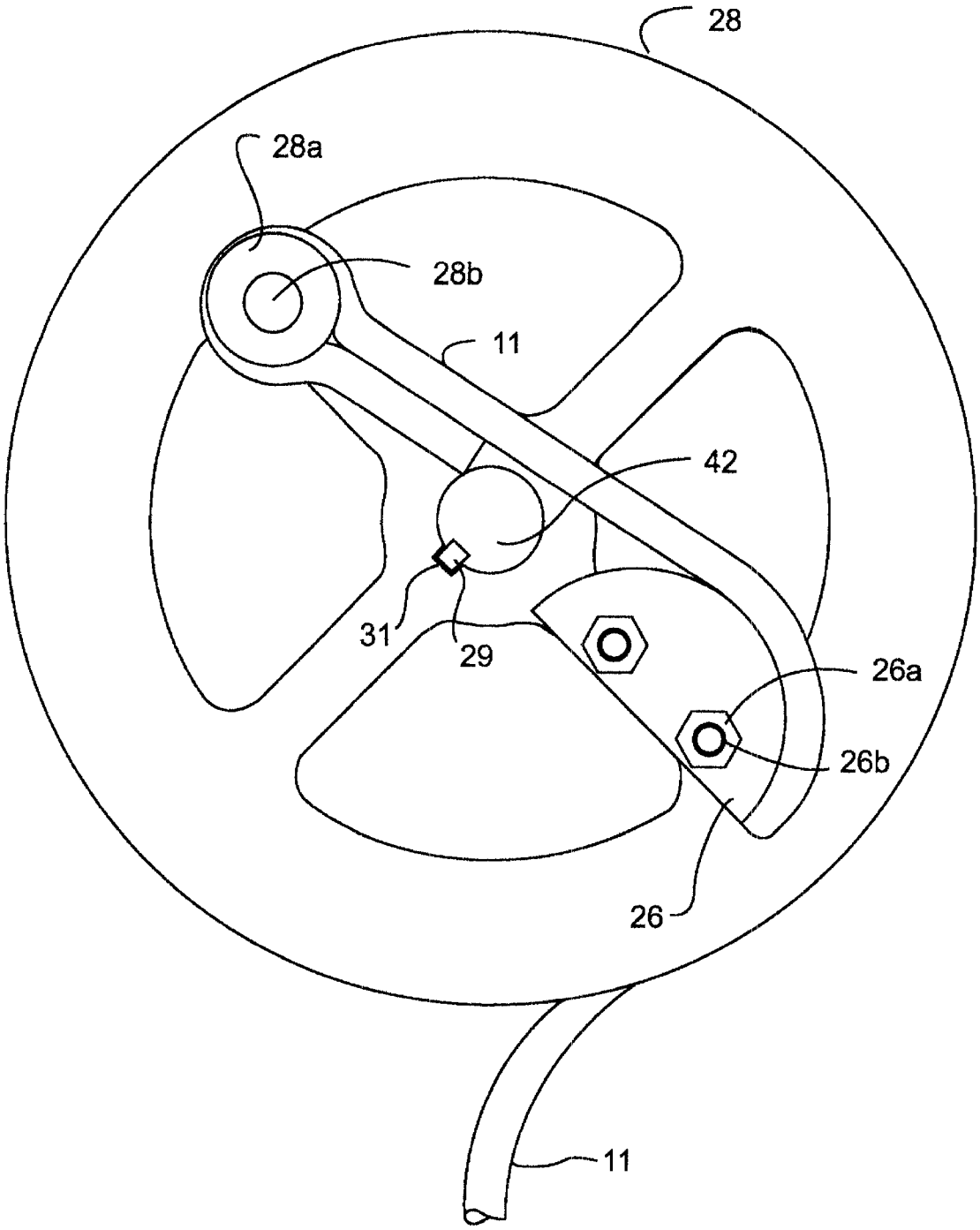
FIG. 10 is a top view of the cable drum of the resistive pack of FIGS. 8 and 9.
Figure 11:
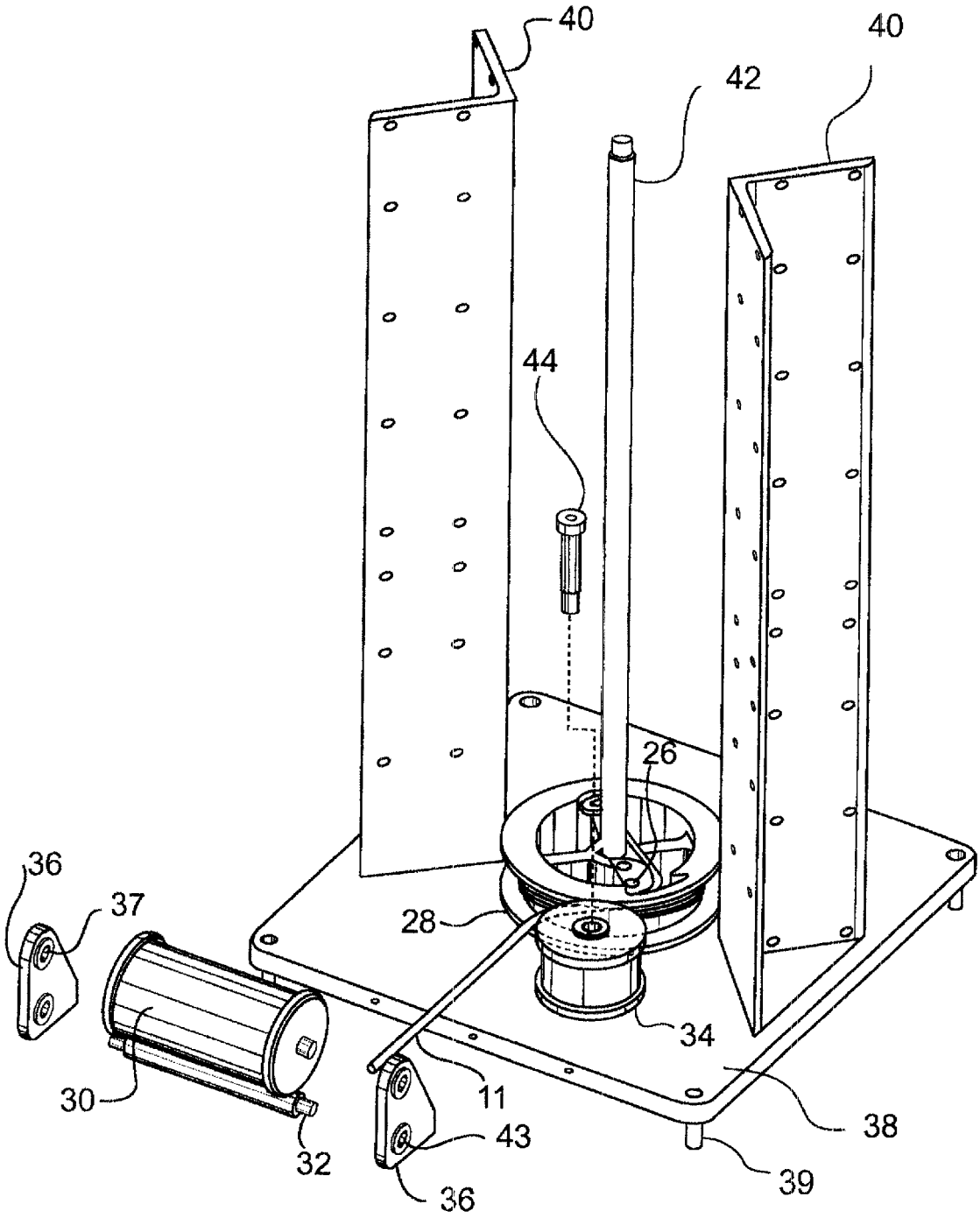
FIG. 11 is a side perspective view of a partially-assembled alternative CFREU with the cable drum and redirect assembly and spring mounts attached.
Figure 12:
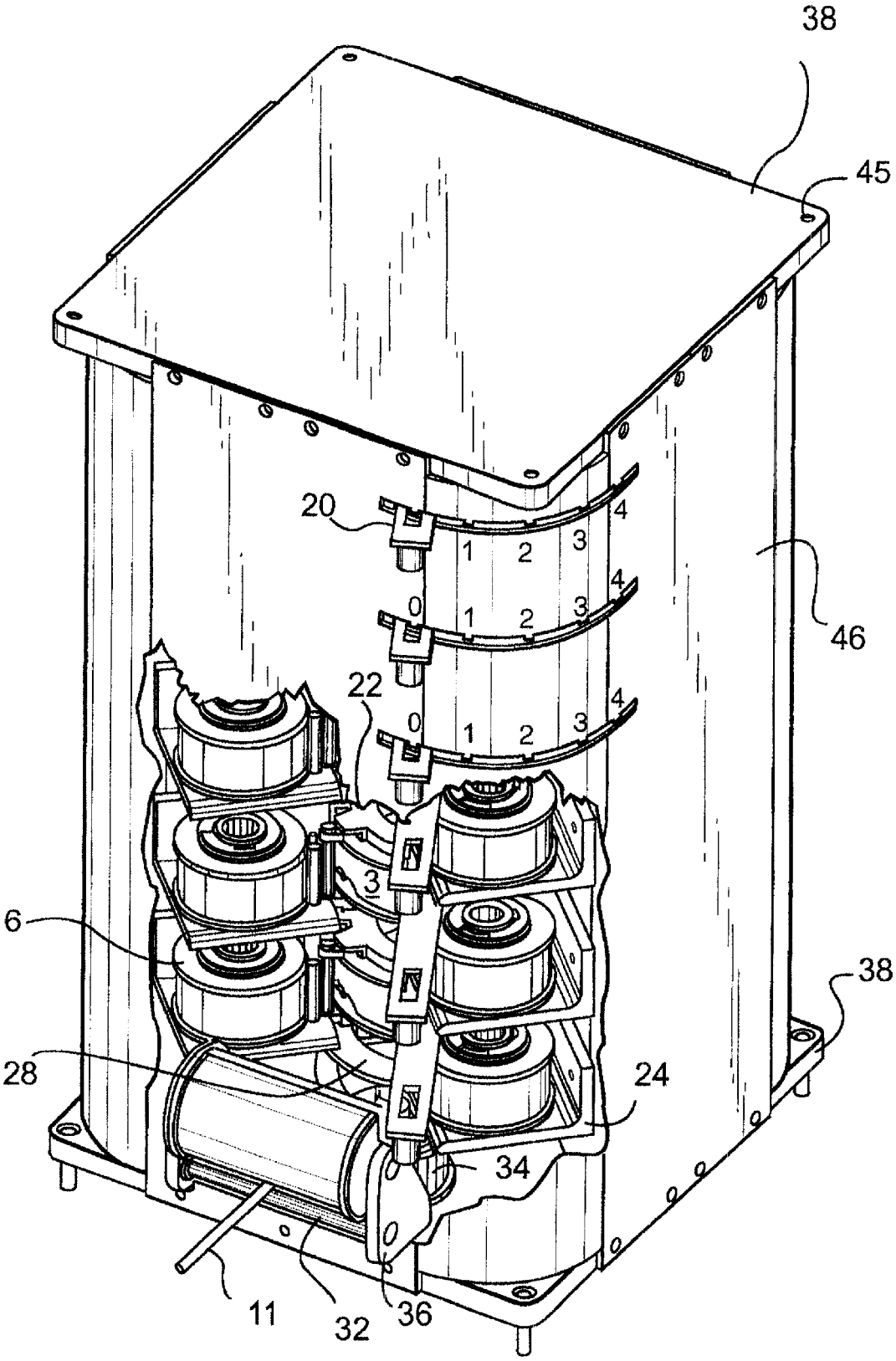
FIG. 12 is a cutaway perspective view of the full alternative CFREU exposing the contant torque spring assemblies attached to the output drums.

FIGS. 8 through 13 illustrate an alternative embodiment of the exercise device of the invention. Mounted vertically within the CFREU 1 (i.e., parallel to the base) is a series of resistive packs 2 that contain a plurality (one to about eight, generally about four) of constant torque springs 8, each housed on its own storage drum 6 attached to the vertical spring mounts 40 of FIG. 11 using storage drum brackets 24 (L-shaped parts fastened to vertical mounts 40 and extending underneath drums 6), a storage drum base 6*g* attached thereto, storage drum fastener 6*e* and an E-clip 6*f*. These springs are oriented radially around a central output drum 3 that connects directly to canister shaft 42. Spring guides 24*a* are mounted on bracket 24 to direct springs 8 to output drum 3. The exploded view of FIGS. 8A to 8C illustrates some of these features in detail, for example the attachment of output drum 3 to canister shaft 42 via shaft lock 42*b*, inside the drum hub 3*h* and hole 3*i*. Lower cam 23 includes cross member 23*a* containing hole 23*b* to accomodate shaft 42. FIG. 8D shows the underside of the cam-output drum assembly. The modular resistive pack is considered to include all the storage drums 6 and springs 8 arranged about output drum 3, plus a selection lever 20 and upper and lower cams 22 and 23. These components occupy a single level area of the CFREU, as seen in FIG. 12.

Levels of resistance are selected in each pack by using the selection lever 20 that connects to the upper selection cam 22. Details of this connection can be seen in FIGS. 8 and 8D. As selection cam 22 is moved from left to right (counterclockwise in FIGS. 8/9) by movement of lever 20, the device adds resistance by allowing additional constant torque springs 8 to be attached to the output drum 3. As seen in FIGS. 8A–8C, upper and lower selection cams 22 and 23 are located above and below output drum 3, and are interconnected with mechanical fasteners 22*a* such as clevis pins through holes 22*e* and 23*e* in the assembly tabs 22*d* and 23*d* on cams 22 and 23, respectively. The pins 22*a* can be secured in place with cotter pins 22*m* or the like. When these units are interconnected with no springs selected (as in FIG. 9), groove blocks 22*f* and 23*c* of the upper and lower cams 22 and 23 are positioned over the selection grooves 3*g* in rim 3*f* of drum 3, thereby preventing the selection pins 8*a* on the output ends of springs 8 from being engaged. Pins 8*a* are held in channels 22*h* and 23*h* of groove blocks 22*f* and 23*c* of the upper and lower cams while engaged. To engage a given spring 8 within the modular pack, the user would grasp knob 13 connected to lever 20 and slide lever 20 to the right, as indicated in FIG. 8. Since lever 20 is mechanically connected to upper selection cam 22 via fasteners 20*a* to inner tab 22*j* and hole 22*k* therein, movement of lever 20 allows the groove blocks 22*f* and 22*c* to expose the selection grooves 3*g* on edges 3*f* of output drum 3. This allows the selection pins 8*a* at the end(s) of at least one spring 8 to engage one of the selection grooves 3*g*, as they are designed to do. As shown in FIG. 8B, spring 8 fits neatly within the spring channel 3*a* and the exposed ends of pins 8*a* seat in upper and lower selection grooves 3*b*. When at least one spring is thus engaged, the resultant torque is transmitted to the cable drum 28 and cable 11 as resistive force.

Figure 8E:
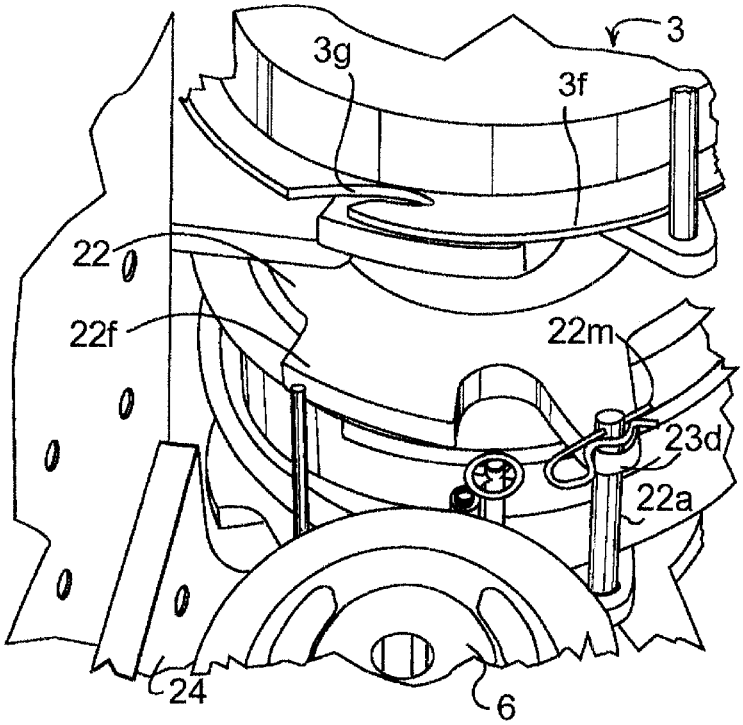
FIGS. 8E and 8F are detailed perspective views of the cams-output drum assembly.
Figure 8F:
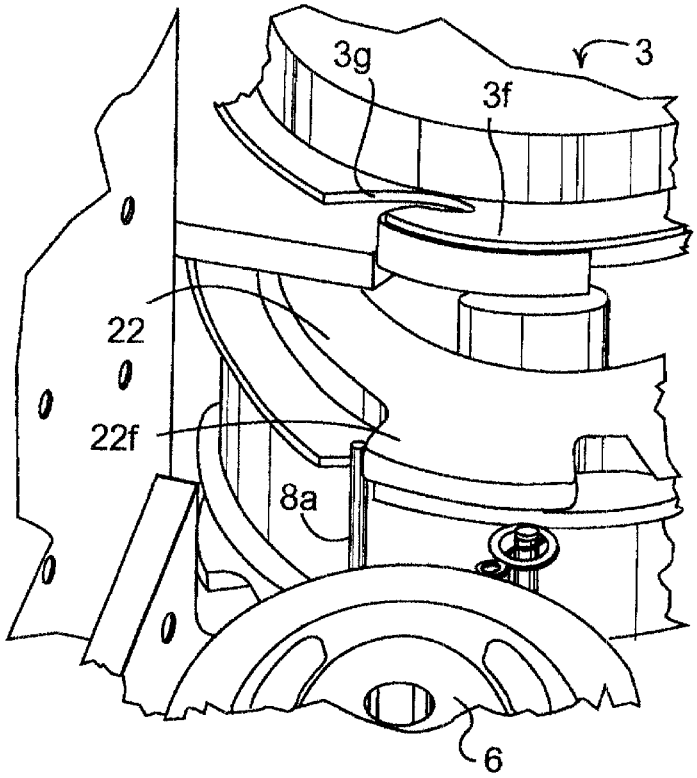

The operation of engaging springs 8 is shown in more detail in FIGS. 8E and 8F, where in FIG. 8E the groove block 22*f* is covering selection groove 3*g* from section pin 8*a*. In FIG. 8F, groove block 22*f* has moved to the right, exposing selection groove 3*g* and allowing selection pin 8*a* to enter the selection groove.

Figure 9:
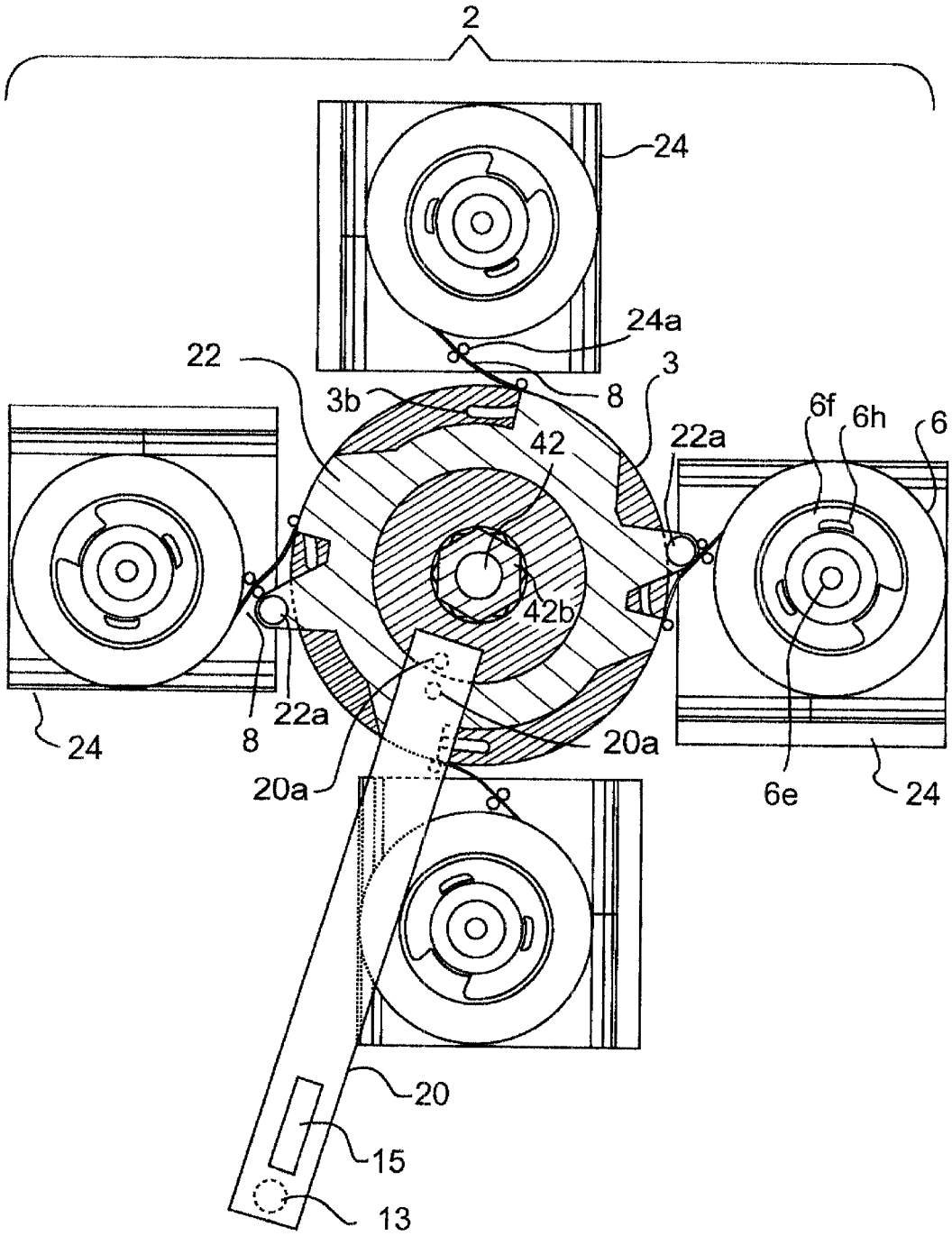
FIG. 9 is a top view of the resistive pack of FIG. 8, with no springs selected.

To disengage a spring, as shown in FIG. 9 the user releases cable 11 and moves lever 20 to the left, allowing groove blocks 22*f* and 22*c* to push selection pins 8*a* out of the selection grooves 3*b* for each spring, and then leaving pins 8*a* to rest upon groove blocks 22*f* and 22*c*.

This is an improvement over the original design described above, where the constant torque springs 8 were permanently attached to the output drum 3 and resistance selection was made by engaging additional output drums 3 and force packs 2. Here, shaft 42 is permanently attached by suitable mechanical means to the output drums 3 of each resistive pack 2, and the springs 8 in each pack are engaged independently. This is facilitated by the use of the lever-and-cam-actuated system to individually attach and detach the ends of each spring in a given pack to the output drum, while the output drum is permanently connected to the output shaft. The total resistive force offered by the device is thus determined by selecting springs individually with the lever and cam system, allowing for better selectivity and a broader range of available resistance forces than in the previous versions.

FIG. 8 illustrates the device with one spring selected (on right side), with lever 20 in the first detent position (See FIG. 13), while FIG. 9 illustrates the device with no springs selected.

As shown in FIGS. 10 and 11, resistance is provided to the user by cables 11, attached to cable drum 28 by cable stop 26, and various commercially available hand or foot attachments similar to those described above. The cable drum 28 is positioned at the base of the CFREU, parallel thereto, and is attached to the canister shaft 42 by mechanical means such as key 29 in keyway 31. The cable stop 26, held by nuts 26*a* on bolts 26*b* (or other suitable fasteners) is positioned as a safety mechanism to prevent the user from exceeding the intended range of motion of the constant torque springs 8. The bitter end of cable 11 is secured to drum 28 by suitable mechanical fasteners such as washer and fastener 28*a* and 28*b*.

Figure 13:
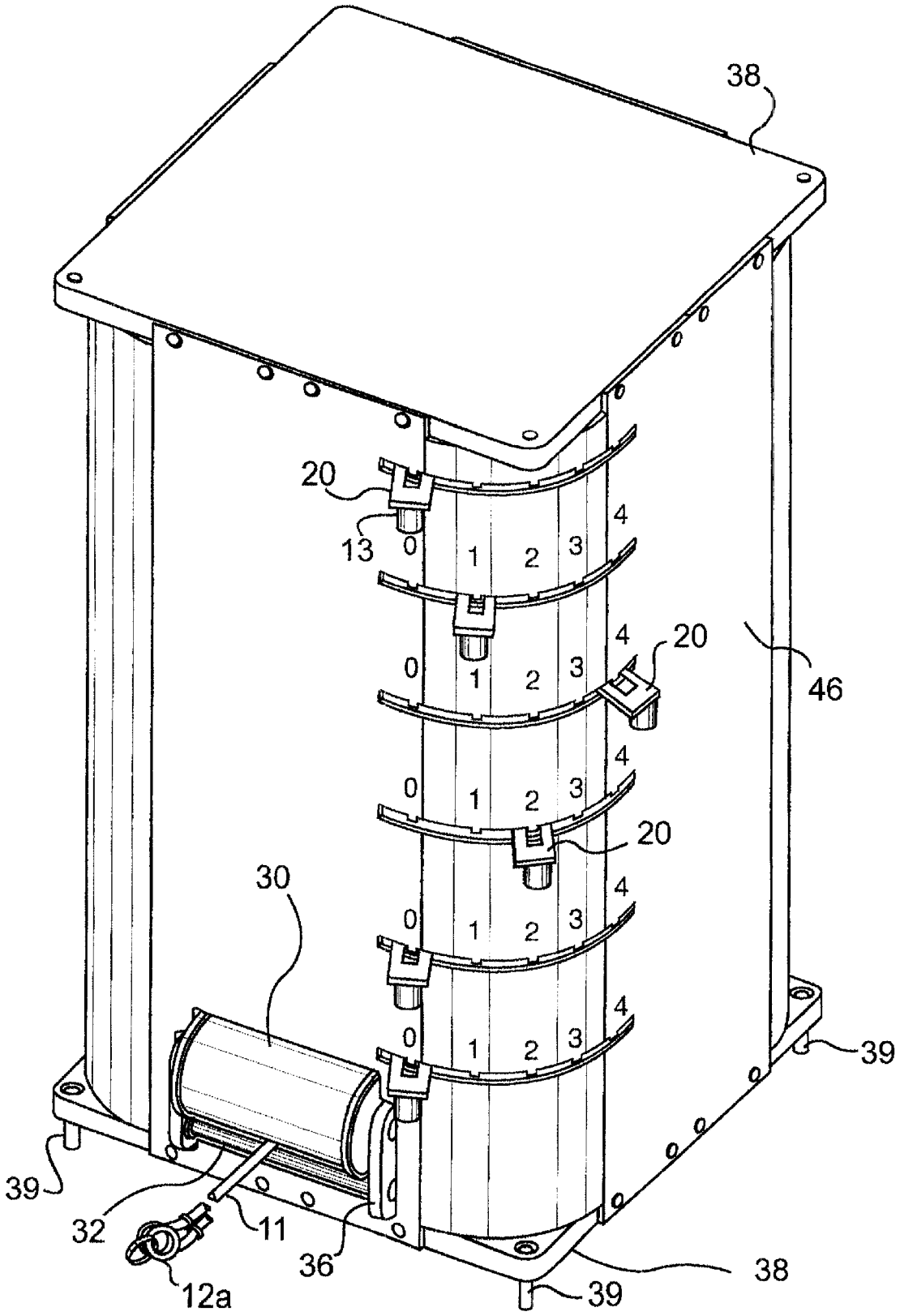
FIG. 13 is a view of the full CFREU illustrating the cable exiting the bottom/front of the unit.

It is preferred to add the redirect idler 34, redirect roller 30, and redirect shaft 32 to direct cable 11 out of the middle front surface of the device and to allow the user to work conveniently in the vertical plane. Redirect idler 34 is held in position by vertical shaft 44 to direct cable 11 to the front of the device as it is uncoiled from the horizontal cable drum 28. Cable 11 then passes between redirect roller 30 and redirect cable shaft 32, which are supported by upper (37) and lower (43) bearings in bracket 36. This roller assembly is positioned at the front center of base 38 (as shown in FIGS. 12 and 13), with brackets 36 mechanically attached to base 38, so that the assembly protrudes outside the front cover 46 of the CFREU's case. The user can then withdraw cable 11 from outside, either in a direction parallel or inclined to base 38, without encountering problems with the cable system. FIG. 13 shows a suitable cable connector 12*a*, such as shackle or the like.

As discussed above for the original embodiment, the CFREU can be attached to any hard surface or existing gym set up by securing the canister end plate 38 to that surface by any suitable means, such as bolts 39 or other mechanical fasteners.

FIGS. 12 and 13 illustrate cutaway perspective views of a complete unit, to show the arrangement of multiple resistive packs on different levels of the case and the operation of the selection levers 20 and the redirect shafts (32) and roller (30). FIGS. 12 and 13 illustrate the CFREU with a top 38 similar to base 38, containing holes 45 which afford additional means of securing the unit in place, e.g. with fasteners 39. Selection levers 20 (shown in detail in FIGS. 8 and 9) are each fitted with knobs or handles 13 (in this case, mounted on the underside of the levers) and include a slot or hole 15. Slot 15 is positioned to catch detents at positions zero, 1, etc. as lever 20 is raised slightly (using knob 13) and moved from left to right. When a lever is in the zero position, no springs are engaged in that pack. Moving the lever to the numbered positions successively engages the corresponding plurality of springs (i.e., 1, 2, 3 or 4) in that particular resistive pack, and the detents at those positions hold lever 20 in place until the user changes its position.

FIG. 13 shows the topmost pack and the two lowest packs with no springs engaged, while the second, third and fourth packs from the top have engaged one, four and two springs, respectively. As discussed above, the packs of this embodiment can contain up to about eight springs. The springs can have the same or varying torque values, perhaps starting at a minimal value of 0.01 inch-pounds, up to about 50,000 inch-pounds. By selectively engaging varied numbers of springs in various packs, it is possible to create resistive forces on cable 11 ranging from about five pounds to 500 or more. Two or more units can be combined to provide total available forces up to 700 pounds or more. For example, if a 5 ft-lb torque spring would produce five pounds of resistive force on the cable, and the unit of FIG. 13 contained only 5 ft-lb springs, the settings shown should produce a resistive force of about 35 pounds. Using four springs on each of the six pack levels would thus produce a total resistive force of (6)(4)(5)=120 pounds. For most adult exercise applications, the CFREU should be fitted with sufficient springs of appropriate torque levels to produce resistive forces ranging from about ten to about 300 pounds. For repeated exercises for rehabilitation programs, it may be desirable to configure the device to provide force ranges from as little as about a half pound up to about fifty pounds.

In each pack level, selection lever 20 can be moved to rotate selection cam 22 and 23 to engage springs 8, in succession, with the output drum 3. FIG. 8 shows a spring pin (or similar connector) 8*a* inserted in groove 3*g* of output drum 3 to connect spring 8 to drum 3, while in FIG. 9, none of the springs are engaged.

This selection system will be better understood with reference to FIGS. 8A through 8C, 8E and 8F, providing detailed perspective views of selection cams 22 and 23 and output drum 3. As with the original design, cable drum 3 has a spring channel 3*a*, with edges 3*f* to retain spring 8 as it is reverse wound onto drum 3. A central hub or bushing 3*h* or other device is provided for mechanically attaching drum 3 to output shaft 42 via shaft hole 3*i*. As shown in FIGS. 8 and 9, drum 3 is attached to shaft 42 by shaft lock 42*b* or other suitable fasteners.

From the foregoing, it will be apparent that the present inventions are well adapted to attain all the ends and objects set forth above, together with other features and advantages which are obvious and inherent in the structures described and illustrated. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter described herein and/or illustrated in the accompanying drawings is to be interpreted as illustrative only, not in a limiting sense. In other words, the scope of the invention is limited only by the appended claims.

We claim:

1. A constant force resistive device, comprising:

a hollow body containing:

at least one modular resistive pack, each of said pack(s) containing at least one constant torque spring, with each spring wound upon a separate storage drum within said pack, and each spring within said pack(s) having the free end mechanically attachable to a single output drum within said pack(s);

each said output drum comprising mechanical means for connection to an output shaft;

which output shaft is mechanically connected to a cable drum having a cable which can be withdrawn to rotate said drum, with mechanical selection means provided for connecting any or all of said springs of said resistive packs to said output shaft, thereby providing resistance to the withdrawal of a cable wound upon said cable drum.

2. The constant force resistive device of claim 1, wherein each of said storage drums is enclosed within said pack(s).

3. The constant force resistive device of claim 1, wherein in each pack said constant torque springs are flat coil springs wound according to their normal curvature upon said storage drums, and are wound onto said single output drum opposite their normal curvature.

4. The constant force resistive device of claim 1, wherein said hollow body is configured to hold a plurality of said modular force packs, with said output shaft and said cable drum protruding from the surface of said body.

5. The constant force resistive device of claim 1, wherein each of said modular packs comprises an output shaft adapted for mechanical interconnection with the shaft(s) of other adjacent packs as installed to form a unitary output shaft, so that any or all of said packs can be engaged with said unitary output shaft by the operation of said selection means.

6. The constant force resistive device of claim 5, wherein said selection means comprise plunger means which are removably connectible to the output drum of each of said packs to connect any of said drums to said output shaft and thus permit engagement of any or all of said modular resistive packs with said output shaft.

7. The constant force resistive device of claim 6, wherein said plunger means are spring-loaded plungers manually adjustable to engage said output shaft.

8. The constant force resistive device of claim 1, wherein each said modular resistive pack has an output drum which is mechanically connected to a common shaft, with said shaft being mechanically connected to a cable drum having a cable which can be withdrawn to rotate said drum.

9. The constant force resistive device of claim 8, wherein the diameter of said cable drum and/or output drum(s) can be varied to alter the amount of resistive force offered by said modular packs which are engaged with said output shaft.

10. The constant force resistive device of claim 8, wherein a plurality of modular resistive packs are installed which permit the selection of resistive forces upon said cable of at least about five pounds.

11. The constant force resistive device of claim 10, wherein said resistive forces are in the range of from about 10 to about 300 pounds.

12. The constant force resistive device of claim 8, wherein each constant torque spring in each of said modular resistive packs can be individually engaged or disengaged by lever-and-cam-actuated selection means.

13. The constant force resistive device of claim 12, wherein said lever-and-cam actuated selection means is adapted to removably connect and disconnect the output ends of any of said constant torque springs to the output drums of their respective packs.

14. The constant force resistive device of claim 12, wherein a plurality of modular resistive packs are installed which permit the selection of individual springs therein to provide resistive forces upon said cable of at least about 5 pounds.

15. The constant force resistive device of claim 1, wherein said cable and said cable drum are fitted with connection means for a user to exert tension upon said cable in exercising.

16. The constant force resistive device of claim 15, wherein said connection means comprise handle means.

17. The constant force resistive device of claim 1, further comprising means for removably attaching at least one surface of said hollow body which parallels said output shaft to at least one surface of a structure for use.

18. The constant force resistive device of claim 17, wherein said attachment means comprise mechanical means.

19. The constant force resistive device of claim 1, wherein said modular resistive packs can each comprise from one to eight of said constant torque springs.

20. The constant force resistive device of claim 1, wherein said modular resistive packs each comprise one or two of said constant torque springs.

21. The constant force resistive device of claim 12, wherein said modular resistive packs each comprise four of said constant torque springs.

22. The constant force resistive device of claim 1, wherein said modular resistive pack(s) each contain at least four constant torque springs, each spring being wound upon its own storage drum and the other end being selectively engageable with a single output drum for said modular pack, each output drum being mechanically attached to a single output shaft, wherein each of said springs of each modular pack can be separately engaged with said output drum of its pack to provide resistive force to said output shaft.

23. The constant force resistive device of claim 22 wherein said springs can be selectively engaged or disengaged by lever-and-cam actuated selection means, with each increment of movement of said lever moving said cam means to expose a selection groove on said output drum and attaching the output end of one of said springs to said selection groove.

24. The constant force resistive device of claim 22, wherein said output shaft is mechanically connected to a cable drum having a cable which can be withdrawn in opposition to said resistive force.

25. The constant force resistive device of claim 22, wherein any of said springs of said modular resistive packs can be mechanically engaged by selection means comprising a selection lever and cam mechanisms which allows for the individual engagement and disengagement of the output end of each spring to said output drum.

26. The constant force resistive device of claim 24, comprising a plurality of said modular resistive packs, wherein the pack nearest the base of said device is adjacent said cable drum.

27. The constant force resistive device of claim 26, wherein the output cable from said cable drum is routed to the user via idler pulley and roller means.

28. The constant force resistive device of claim 22, further comprising a base adapted for removable connection to at least one surface of a structure for use of said device.

29. A constant force resistive device, comprising:

a hollow body containing:

a plurality of modular resistive packs, each of said packs comprising at least one constant torque spring, each spring being attached to a separate storage drum within said pack, being wound upon said storage drum according to its normal curvature, with each spring within a pack having its free end mechanically attached to a single output drum within that pack, upon it can be wound in opposition to its normal curvature;

each of said packs having independent means for mechanically connecting said output drum to an output shaft for said pack, wherein each of said output shafts are adapted for mechanical interconnection to the shafts of the adjacent packs, and the interconnected output shafts of all said packs form a unitary output shaft mechanically connected to a cable drum, with mechanical selection means provided for connecting any or all of said output drums of said modular packs to said output shaft, thereby providing resistance to the withdrawal of a cable wound upon said cable drum.

30. The device of claim 29 wherein said output shafts are interconnected with mechanical means comprising mechanical fasteners.

31. The device of claim 29 which comprises mechanical selection means comprising plunger means for individually engaging and disengaging each of said resistance packs from said unitary output shaft.

32. The device of claim 31 wherein said plunger means comprise spring-loaded plungers.

33. A constant force resistive device comprising a hollow body set upon a base, said base having mounted thereon a cable drum with cable wound thereon;

a plurality of constant torque spring resistive packs mounted upon said base and parallel thereto in stacked fashion, each spring resistive pack comprising a central output drum and a plurality of storage drums on the circumference of said central drum, with each storage drum containing a constant torque spring whose free end can be selectively mechanically attached to said central output drum, and each resistive pack having mechanical selection means comprising lever and cam means for selectively engaging any of said springs in said pack;

each said central output drum being mechanically connected to a central output shaft, and said output shaft being mechanically connected to said cable drum so as to provide a resistive force to the withdrawal of said cable when at least one of said constant torque springs is engaged.

34. The device of claim 33 wherein said mechanical selection means engage springs by allowing the spring's free end to fall into a groove on said output drum and thereby engage said drum, and disengage springs by removing the free end from said groove.

35. The device of claim 33 wherein said constant torque springs have torque values selected from values in the range of from about 0.01 to about 50,000 inch-pounds.

36. A modular resistive pack comprising at least four storage drums spaced radially about a central output drum, with each said storage drum having a flat coil spring wound thereon according to its natural curvature, and means for selectively engaging or disengaging each said spring to said output drum to be wound thereon opposite to the natural curvature of said springs as said output drum is rotated, with means for connecting said output drum to an output shaft.

* * * * *